US012569072B2

(12) United States Patent
Maschi et al.

(10) Patent No.: US 12,569,072 B2
(45) Date of Patent: Mar. 10, 2026

(54) SIT-TO-STAND CONVERTIBLE HIGHCHAIR

(71) Applicant: Veza Innovations, LLC, Clarksburg, MD (US)

(72) Inventors: Karen Maschi, Clarksburg, MD (US); Robert Soreo, Cleveland Heights, OH (US); Matt Wright, Shaker Heights, OH (US)

(73) Assignee: Veza Innovations Inc., Clarksburg, MD (US)

( * ) Notice: Subject to any disclaimer, the term of this patent is extended or adjusted under 35 U.S.C. 154(b) by 211 days.

(21) Appl. No.: 18/311,313

(22) Filed: May 3, 2023

(65) Prior Publication Data

US 2023/0355006 A1 Nov. 9, 2023

Related U.S. Application Data

(60) Provisional application No. 63/337,666, filed on May 3, 2022.

(51) Int. Cl.

| | |
|---|---|
| ***A47D 1/00*** | (2006.01) |
| ***A47C 13/00*** | (2006.01) |
| ***A47D 1/02*** | (2006.01) |

(52) U.S. Cl.

CPC ..... *A47D 1/023* (2017.05); *A47C 13/00* (2013.01); *A47D 1/004* (2013.01); *A47D 1/0085* (2017.05)

(58) Field of Classification Search

CPC ..... A47D 1/004; A47D 1/002; A47D 1/04; A47D 1/0085; A47D 1/0081; A47D 1/0083

See application file for complete search history.

(56) References Cited

U.S. PATENT DOCUMENTS

| | | | | |
|---|---|---|---|---|
| 2,606,593 A | | 8/1952 | Beurskens | |
| 2,606,594 A | | 8/1952 | Caldemeyer | |
| 4,946,180 A | * | 8/1990 | Baer | A47D 1/0081 280/47.38 |
| 5,407,246 A | | 4/1995 | Meeker et al. | |

(Continued)

FOREIGN PATENT DOCUMENTS

| | | | | |
|---|---|---|---|---|
| CN | 101489444 A | * | 7/2009 | A47D 1/004 |
| CN | 201480759 U | | 5/2010 | |

(Continued)

OTHER PUBLICATIONS

International Search Report and Written Opinion for corresponding International Application No. PCT/US2023/020770, issued Aug. 17, 2023.

(Continued)

*Primary Examiner* — Timothy J Brindley

(74) *Attorney, Agent, or Firm* — Renner, Otto, Boisselle & Sklar, LLP

(57) ABSTRACT

A sit-to-stand convertible highchair includes a frame configured to support the sit-to-stand convertible highchair above a floor, a foot platform adjustably mounted on the frame, and a seat assembly adjustably mounted on the frame above the foot platform. The seat assembly includes a backrest and a support surface configured to convert between a sitting configuration, in which a user may sit on the support surface, and a standing configuration, in which the user may extend through the support surface to stand on the foot platform.

21 Claims, 24 Drawing Sheets

(56) References Cited

U.S. PATENT DOCUMENTS

| | | | | |
|---|---|---|---|---|
| 5,407,247 | A | 4/1995 | Forcier et al. | |
| 5,437,493 | A * | 8/1995 | Weisleder | B62B 9/26 297/150 |
| 5,857,944 | A | 1/1999 | Cone et al. | |
| 5,857,945 | A | 1/1999 | Papp et al. | |
| 6,568,752 | B1 * | 5/2003 | Lu | A47D 1/023 297/42 |
| 7,234,722 | B1 | 6/2007 | Madigan et al. | |
| 7,234,723 | B2 | 6/2007 | Sellers | |
| 7,727,076 | B2 | 6/2010 | Bapst et al. | |
| 8,302,978 | B2 | 11/2012 | You et al. | |
| 8,302,979 | B2 | 11/2012 | Buschjohann et al. | |
| 8,303,033 | B2 | 11/2012 | Lundeen | |
| 8,303,034 | B2 | 11/2012 | Gross et al. | |
| 8,720,988 | B1 | 5/2014 | Underwood et al. | |
| 8,720,989 | B2 | 5/2014 | Jurcic et al. | |
| 8,807,588 | B2 | 8/2014 | Thomas et al. | |
| 8,960,788 | B2 | 2/2015 | Chuah | |
| 8,960,789 | B2 | 2/2015 | McCormick et al. | |
| 9,877,598 | B2 | 1/2018 | Fine | |
| 9,877,599 | B2 | 1/2018 | Turner et al. | |
| 10,000,225 | B2 | 6/2018 | Burns et al. | |
| 10,000,226 | B2 | 6/2018 | Yi | |
| 2012/0261957 | A1 | 10/2012 | Tadin et al. | |
| 2012/0261958 | A1 | 10/2012 | Hutchinson et al. | |
| 2016/0174727 | A1 * | 6/2016 | Haut | A47D 1/103 297/130 |
| 2021/0037989 | A1 | 2/2021 | Rogers et al. | |
| 2021/0085094 | A1 * | 3/2021 | Rosenthal | A47D 1/004 |
| 2024/0335051 | A1 * | 10/2024 | Yang | A47D 1/004 |
| 2025/0049228 | A1 * | 2/2025 | Longenecker | A47D 11/00 |

FOREIGN PATENT DOCUMENTS

| | | | | |
|---|---|---|---|---|
| CN | 111280946 | A * | 6/2020 | A47D 1/004 |
| CN | 114947460 | A * | 8/2022 | |
| DE | 9311003 | U1 * | 11/1993 | |
| DE | 10202735 | A1 * | 8/2003 | A47D 1/004 |
| DK | 159367 | B * | 10/1990 | |
| JP | S5358766 | U | 5/1978 | |
| KR | 20170086976 | A * | 7/2017 | |

OTHER PUBLICATIONS

International Preliminary Report on Patentability for corresponding International Application No. PCT/US2023/020770, issued Oct. 29, 2024.

OPSVIK, Stokke Nomi High Chair, https://www.stokke.com/USA/en-us/high-chairs/stokke-nomi, retrieved on May 8, 2023.

OPSVIK, Tripp Trapp—The Chair That Grows With The Child, https://www.stokke.com/USA/en-us/high-chairs/tripp-trapp/TT01.html, retrieved on May 8, 2023.

* cited by examiner

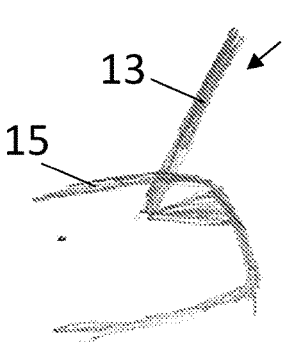
FIG. 62A
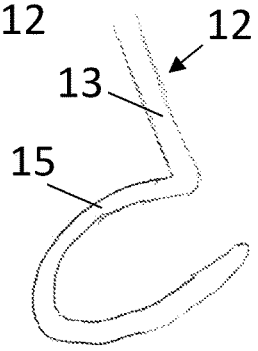
FIG. 62B
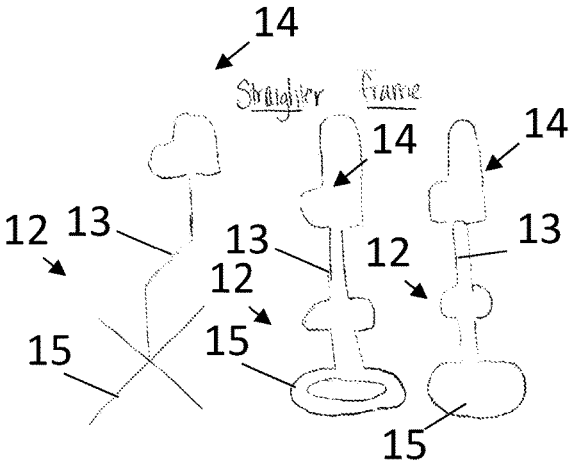
FIG. 62C
FIG. 62D
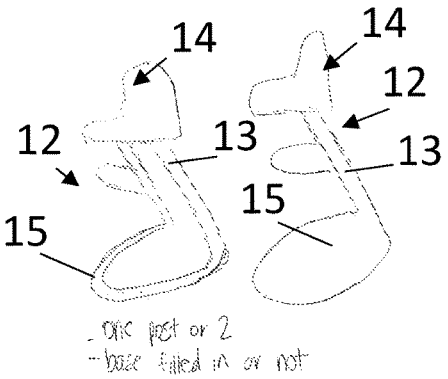
FIG. 62E
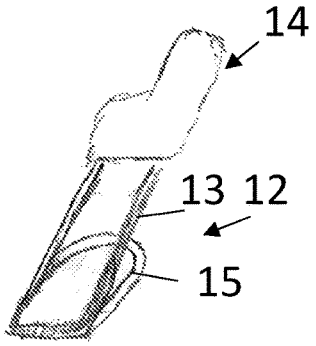
FIG. 62F
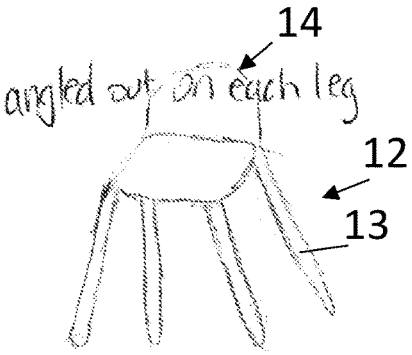
FIG. 62F
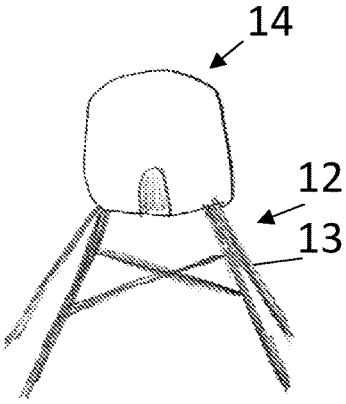
FIG. 62G
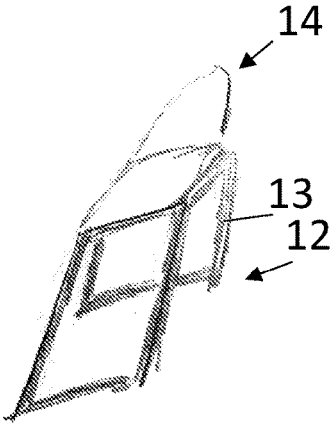
FIG. 62H

SIT-TO-STAND CONVERTIBLE HIGHCHAIR

This application is a non-provisional and claims priority of U.S. of America provisional Application No. 63/337,666, filed May 3, 2022, which is hereby incorporated herein by reference in its entirety.

TECHNICAL FIELD

The present disclosure relates generally to highchairs, and more particularly to convertible highchairs.

BACKGROUND

Highchairs are widely used by parents every day to provide a seat for their child to eat. Typically, highchairs include a rigid seat portion that is supported above the floor with a frame or stand. The seats are typically positioned at a height above the floor, with for example the frame or stand, so that the child can sit at the height of a normal table while eating their food. Sometimes, highchairs include a footrest supported by the stand below the seat portion on which the child can rest their feet when they sit in the seat.

Oftentimes, children can become uncomfortable, fidgety or fussy when sitting and secured in a typical highchair during mealtime, as they are unable to stand up or extend or stretch their bodies. This can interfere with mealtime cooperation or even their ability or willingness to eat. Although some highchairs provide some adjustability for height of the seat or footrest, typical highchairs do not provide much adjustability to accommodate positional preferences of the child.

SUMMARY

A sit-to-stand convertible highchair is described herein that is adjustable without tools and convertible between a sitting configuration and a standing configuration, to accommodate positional preferences of a child during mealtime, according to their developmental readiness. In both the sitting and standing configuration, the sit-to-stand convertible highchair is configured to allow the child to sit or stand, respectively, in an upright and secure position to aid in digestion and allow the child to swallow food more efficiently, and to create a more pleasant mealtime experience for both the child and parent. The sit-to-stand convertible highchair includes seat assembly and a weight bearing foot platform that are each independently or commensurately adjustable in a height direction on a stand that supports the seat assembly and the foot platform above a floor.

According to an aspect of this disclosure, a sit-to-stand convertible highchair includes a frame configured to support the sit-to-stand convertible highchair above a floor, a foot platform adjustably mounted on the frame, and a seat assembly adjustably mounted on the frame above the foot platform. The seat assembly includes a backrest and a support surface configured to convert between a sitting configuration, in which a user may sit on the support surface, and a standing configuration, in which the user may extend through the support surface to stand on the foot platform.

According to an embodiment of one or more paragraph(s) of this disclosure, the support surface includes a peripheral seat frame and a central seat portion within the peripheral seat frame. The central seat portion of the support surface is configured to be movable relative to the peripheral seat frame to convert between the sitting configuration, in which the central seat portion of the support surface is in a first position flush with the peripheral seat frame to provide a continuous sitting surface on which the user may sit, and the standing configuration, in which the central seat portion of the support surface is in a second position exposing an aperture defined by the peripheral seat frame through which the user may extend to stand on the foot platform.

According to an embodiment of one or more paragraph(s) of this disclosure, the sit-to-stand convertible highchair further includes a plurality of armrests each arranged on a respective lateral side of the seat assembly, and at least one removable tray configured to extend between and variably engage with the plurality of armrests.

According to an embodiment of one or more paragraph(s) of this disclosure, at least one of the plurality of armrests is movable to variably engage and accommodate the at least one removable tray.

According to an embodiment of one or more paragraph(s) of this disclosure, at least one of the plurality of armrests is vertically pivotable or laterally pivotable.

According to an embodiment of one or more paragraph(s) of this disclosure, the plurality of armrests, support surface and backrest are each supported on a support rod.

According to an embodiment of one or more paragraph(s) of this disclosure, the support rod includes a recessed track in which at least one of the plurality of armrests is configured to slide.

According to an embodiment of one or more paragraph(s) of this disclosure, the removable tray includes a spring-loaded lock configured to variably engage with at least one of the plurality of armrests, and a release lever configured to release the spring-loaded lock to variably disengage with the at least one of the plurality of armrests.

According to an embodiment of one or more paragraph(s) of this disclosure, the central seat portion of the support surface is pivotably attached to the peripheral seat frame and is configured to be pivotable relative to the peripheral seat frame to convert the sit-to-stand convertible highchair between the sitting configuration and the standing configuration.

According to an embodiment of one or more paragraph(s) of this disclosure, in the standing configuration, the central seat portion of the support surface is pivoted upward relative to the peripheral seat frame to form a supplementary backrest for the user as the user extends through the aperture to stand on the foot platform.

According to an embodiment of one or more paragraph(s) of this disclosure, the sit-to-stand convertible highchair further includes a crotch strap secured to the peripheral seat frame at a first end of the crotch strap and at a second end of the crotch strap, the crotch strap extending across the aperture from the first end to the second end.

According to an embodiment of one or more paragraph(s) of this disclosure, the crotch strap is removably secured to the peripheral seat frame at at least one of the first end or the second end.

According to an embodiment of one or more paragraph(s) of this disclosure, the sit-to-stand convertible highchair further includes a cushion on an underside of the central seat portion.

According to an embodiment of one or more paragraph(s) of this disclosure, the at least one removable tray is foldable According to an embodiment of one or more paragraph(s) of this disclosure, the frame includes a base and a post. At least one of the seat assembly and the foot platform includes an integrated mating feature configured to variably secure the at least one of the seat assembly and the foot platform to the post.

According to an embodiment of one or more paragraph(s) of this disclosure, the post includes a plurality of notches along a vertical direction thereof, and the integrated mating feature of at least one of the seat assembly and the foot platform includes an adjustment latch configured to releasably engage at least one of the notches.

According to an embodiment of one or more paragraph(s) of this disclosure, the post includes a plurality of geometric recesses along a vertical direction thereof, and the integrated mating feature of at least one of the seat assembly and the foot platform includes a corresponding geometric projection configured to variably engage at least one of the plurality of geometric recesses.

According to an embodiment of one or more paragraph(s) of this disclosure, the integrated mating feature of at least one of the seat assembly and the foot platform includes at least one angled rubber wedge configured to variably engage the post.

According to an embodiment of one or more paragraph(s) of this disclosure, the integrated mating feature of at least one of the seat assembly and the foot platform further includes a compression lock configured to move between an unlocked position, in which the integrated mating feature is able to move relative to the post, and a locked position, in which the integrated mating feature is unable to move relative to the post .

According to an embodiment of one or more paragraph(s) of this disclosure, the seat assembly further includes a harness assembly including at least one crotch harness strap, at least two waist harness straps, and at least two shoulder harness straps. Each of the at least one crotch harness strap, the at least two waist harness straps, and the at least two shoulder harness straps are independently connectable to each other.

According to another aspect of the disclosure, a sit-to-stand convertible highchair includes a frame configured to support the sit-to-stand convertible highchair above a floor, a foot platform adjustably mounted on the frame, and a seat assembly adjustably mounted on the frame above the foot platform. The seat assembly includes a backrest and a support surface movable for converting the sit-to-stand convertible highchair between a sitting configuration, in which the support surface is configured to support a user in a sitting position, and a standing configuration, in which the foot platform is configured to support the user in a standing position.

The following description and the annexed drawings set forth in detail certain illustrative embodiments described in this disclosure. These embodiments are indicative, however, of but a few of the various ways in which the principles of this disclosure may be employed. Other objects, advantages and novel features will become apparent from the following detailed description when considered in conjunction with the drawings.

BRIEF DESCRIPTION OF DRAWINGS

The annexed drawings show various aspects of the disclosure.

FIGS. 62A-K are schematic diagrams of various embodiments of a frame of the sit-to-stand convertible highchair.

DETAILED DESCRIPTION

Figure 1:
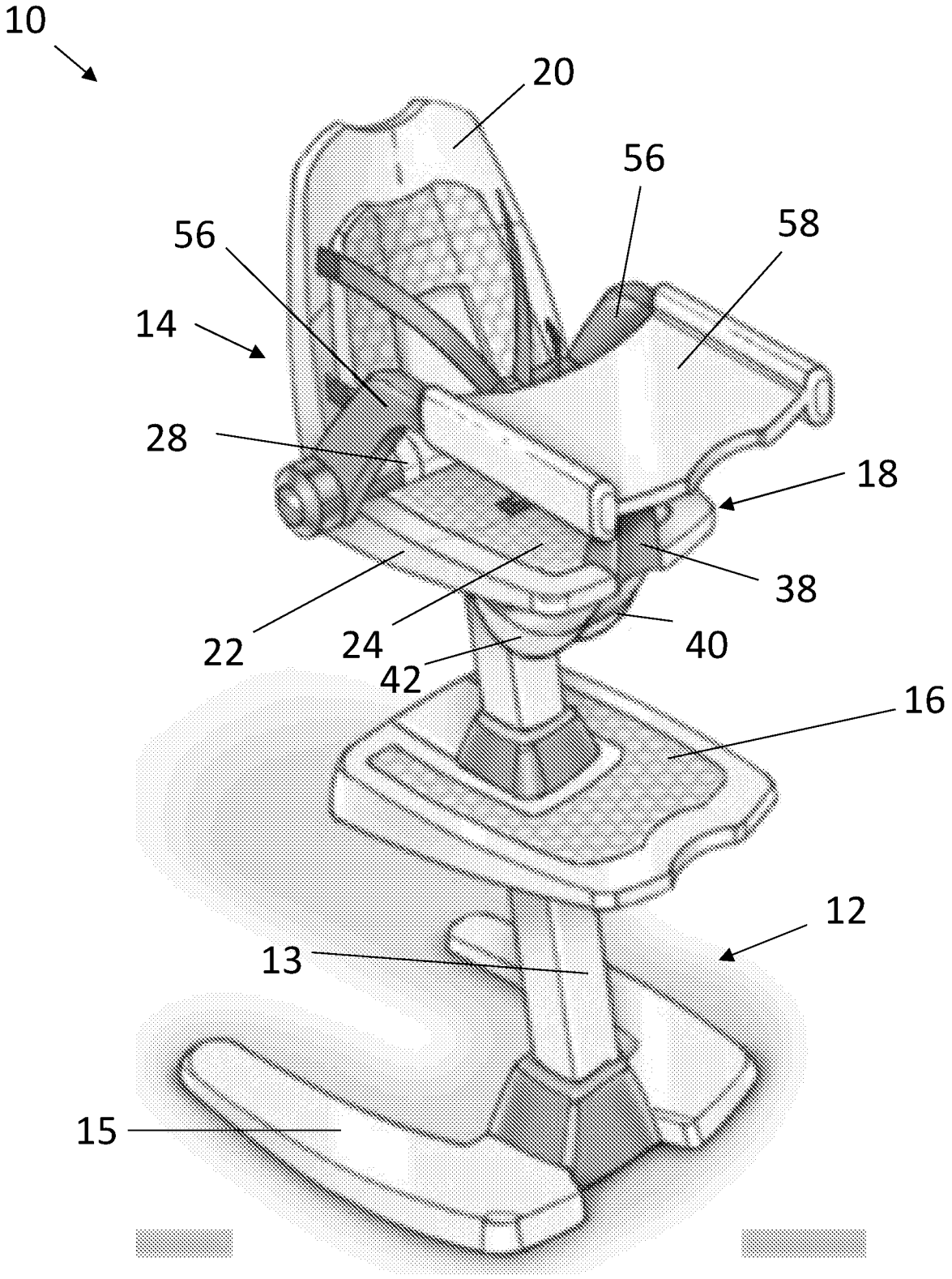
FIG. 1 is a perspective view of a sit-to-stand convertible highchair in a sitting configuration.
Figure 2:
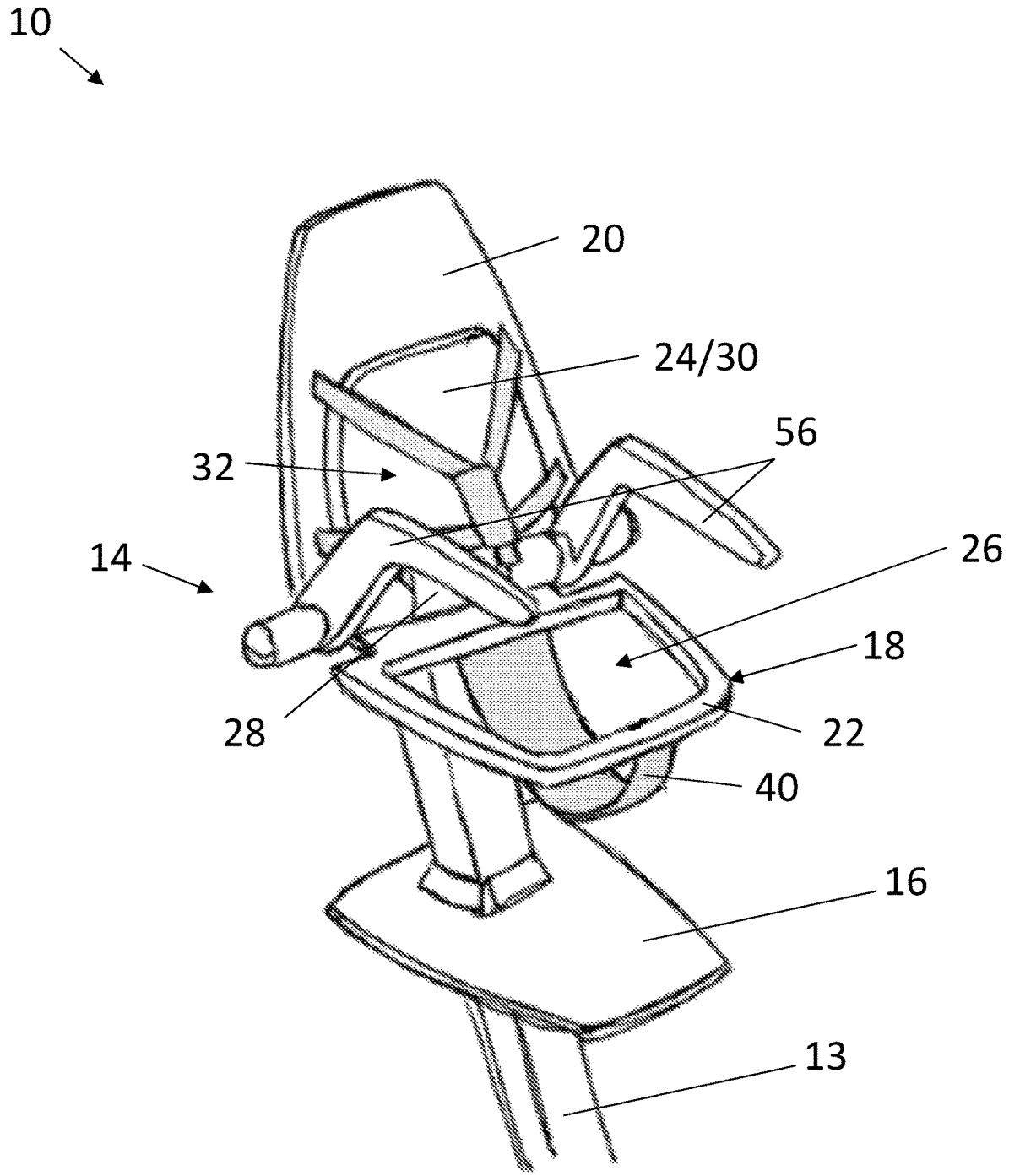
FIG. 2 is a perspective view of the sit-to-stand convertible highchair in a standing configuration.
Figure 3:
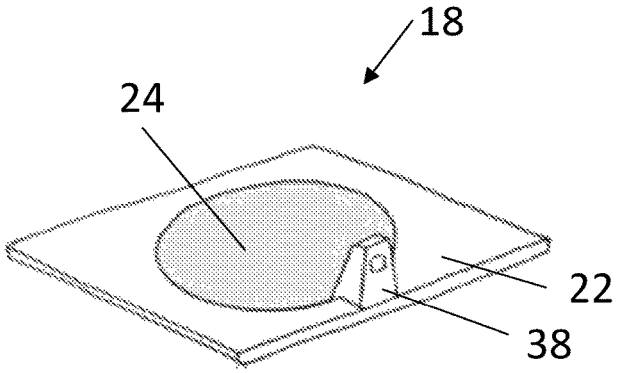
FIG. 3 is a perspective view of a seat assembly of the sit-to-stand convertible highchair in the sitting configuration.
Figure 4:
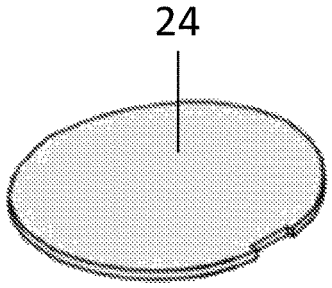
FIG. 4 is a perspective view of a central seat portion of a seat assembly of the sit-to-stand convertible highchair.

Described herein is a sit-to-stand convertible highchair. With reference to FIGS. 1 and 2, the sit-to-stand convertible highchair 10 includes a frame 12 configured to support the highchair 10 above a floor, and foot platform 16 adjustably mounted on the frame 12. The highchair 10 also includes a seat assembly 14 adjustably mounted on the frame 12 above the foot platform 16. The frame 12 may include a post 13 and a base 15. The base 15 may provide a stable support for the highchair 10 on a floor, and the post 13 is configured to extend vertically upward from the base 15 at an angle relative to the base 15 for supporting the seat assembly 14 and the foot platform 16 above the floor. The seat assembly 14 includes a support surface 18 and a backrest 20. The support surface 18 is movable for converting the sit-to-stand convertible highchair 10 between a sitting configuration (FIG. 1), in which the support surface 18 is configured to support a user (a child) in a sitting position in the highchair 10, and a standing configuration (FIG. 2), in which the foot platform is configured to support the user in a standing position in the highchair 10. For example, the support surface 18 may be configured to convert between the sitting configuration (FIG. 1), in which the user may sit on the support surface 18, and the standing configuration (FIG. 2), in which the user may extend through the support surface 18 to stand on the foot platform 16. In both the sitting configuration (FIG. 1) and the standing configuration (FIG. 2), the foot platform 16 is positioned on the frame 12 below the seat assembly 14 such that it provides a surface to support the user's feet. For example, when the user is sitting in the highchair 10 in the sitting configuration (FIG. 1), the foot platform 16 encourages the user to sit in an upright position. In this manner, the foot platform 16 provides a sense of grounding for the user when sitting in the highchair 10 in the sitting configuration (FIG. 1) or standing in the highchair 10 in the standing configuration (FIG. 2), which increases stability of the user in the highchair. The foot platform 16 may extend at least partially on all sides of the frame 12 to provide a wide base for grounding the user. Additionally, the foot platform 16 is completely removable from the frame 12 so as to convert the highchair 10 into a chair, having only the seat assembly 14 without the foot platform 16. Both the support surface 18 and the foot platform 16 are configured to independently support a full weight of the user, whether the user is in the sitting position in the sitting configuration of the highchair 10 or in the standing position in the standing configuration of the highchair 10.

The support surface 18 may have a peripheral seat frame 22 and a central seat portion 24 within the peripheral seat frame 22. The central seat portion 24 of the support surface 18 is configured to be movable relative to the peripheral seat frame 22 to convert the support surface 18 (and, therefore, the highchair 10) between the sitting configuration (FIG. 1) and the standing configuration (FIG. 2). In the sitting configuration (FIG. 1), the central seat portion 24 of the support surface 18 is in a first position flush with the peripheral seat frame 22 to provide a continuous sitting surface of the support surface 18 on which the user may sit. In the standing configuration (FIG. 2), the central seat portion 24 of the support surface 18 is in a second position exposing an aperture 26 defined by the peripheral seat frame 22, through which the user may extend to stand on the foot platform 16 beneath the support surface 18.

In one embodiment, depicted in FIGS. 1 and 2, the central seat portion 24 of the support surface 18 is hingedly secured to the peripheral seat frame 22 and may be pivoted at a hinge 28 relative to the peripheral seat frame 22 to convert between the sitting configuration (FIG. 1) and the standing configuration (FIG. 2). Specifically, the central seat portion 24 may be hingedly secured to a rear of the peripheral seat frame 22 near where the backrest 20 meets the support surface 18. In the sitting configuration (FIG. 1), the central seat portion 24 may be pivoted downward toward the aperture 26 of the peripheral seat frame 22 to form the continuous sitting surface of the support surface 18, and in the standing configuration (FIG. 2), the central seat portion 24 is pivoted upward away from the aperture 26, toward the backrest 20, to expose the aperture 26 through which the user may extend to stand on the foot platform 16 beneath the support surface 18. In the standing configuration (FIG. 2), when the central seat portion 24 is pivoted upward away from the aperture 26 and toward the backrest 20, the central seat portion 24 forms a supplementary standing backrest 30 for supporting the user in the standing configuration (FIG. 2). The central seat portion 24 may include a cushion 32 or padding on an underside of the central seat portion 24, such that when it is pivoted upward in the standing configuration (FIG. 2), the supplementary standing backrest 30 formed by the central seat portion 24 provides a comfortable and cushioned support for the user's back with the cushion 32.

Figure 5:
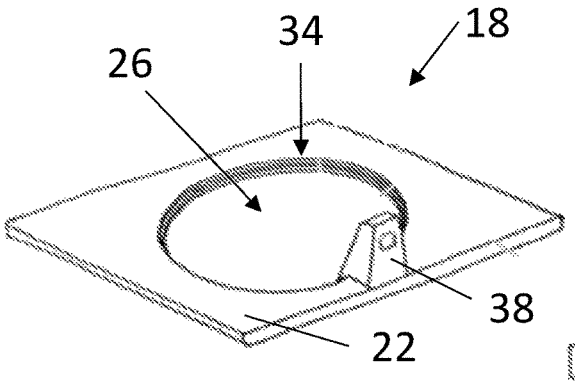
FIG. 5 is another perspective view of the seat assembly of the sit-to-stand convertible highchair in the standing configuration.
Figure 6:
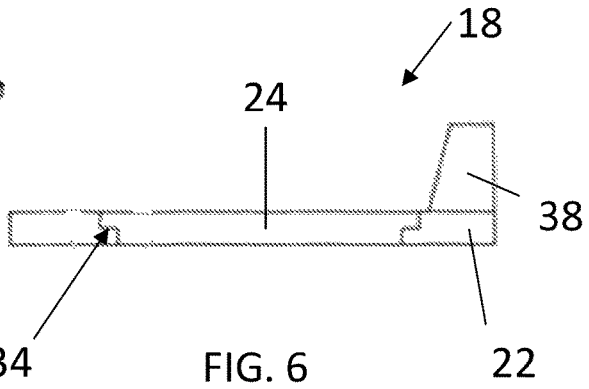
FIG. 6 is a cross-sectional view of the seat assembly of the sit-to-stand convertible highchair in the sitting configuration.

In another embodiment, depicted in FIGS. 3-7, the central seat portion 24 of the support surface 18 may be wholly inserted and removed from the support surface 18 for converting between the sitting configuration (FIG. 3) and the standing configuration (FIG. 5). For example, in the sitting configuration (FIG. 3), the central seat portion 24 may be inserted into the support surface 18 to cover the aperture 26 and form the continuous sitting surface of the support surface 18, and in the standing configuration (FIG. 5), the central seat portion 24 may be removed from the support surface 18 to expose the aperture 26. In this embodiment, the central seat portion 24 of the support surface 18 may be removably attached to the peripheral seat frame 22 of the support surface 18 at a periphery 34 of the aperture 26 with, for example, a stepped interface (as depicted), a tongue and groove connection, magnets, posts and recesses, or any other suitable fixing means. In this manner, the central seat portion 24 of the support surface 18 may be easily removed from the peripheral seat frame 22 to expose the aperture 26 and convert the support surface 18 and highchair 10 from the sitting configuration (FIG. 3) to the standing configuration (FIG. 5).

Figure 7:
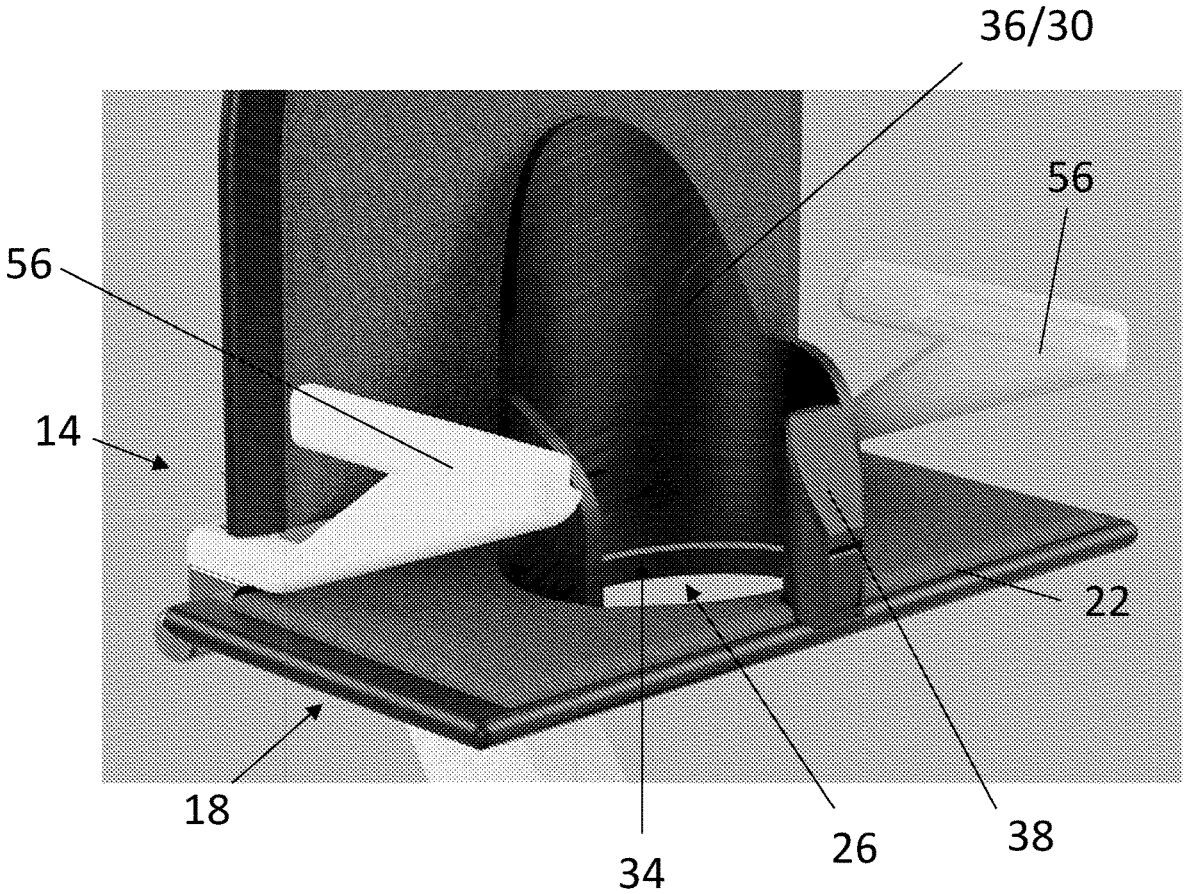
FIG. 7 is another perspective view of the seat assembly of the sit-to-stand convertible highchair in the standing configuration.

In this embodiment, with specific reference to FIG. 7, a backrest insert 36 may be inserted onto or removed from the support surface 18 to form the supplementary standing backrest 30 for supporting the user in the standing configuration (FIG. 5). The backrest insert 36 may, for example, be planar or may be curved along a periphery 34 of the aperture 26 of the support surface 18 and may extend vertically from the periphery 34 of the aperture 26. The backrest insert 36 may be removably attached to the peripheral seat frame 22 of the support surface 18 at the periphery 34 of the aperture 26 with, for example, a stepped interface, a tongue and groove connection, magnets, posts and recesses, or any other suitable fixing means. The backrest insert 36 may also be attached to the support surface 18 in the sitting configuration (FIG. 3) for providing additional support to the user when the user is sitting on the support surface 18. The backrest insert 36 may also include a cushion or padded fabric on a front face thereof for providing a comfortable and cushioned support for the user's back. Similarly, a sitting cushion insert may be inserted onto or removed from the support surface 18 in the sitting configuration for providing additional support and comfort to the user while sitting on the support surface 18 in the sitting configuration. The sitting cushion insert may come in a plurality of standard sizes based on various stages of development, or may be custom made for the user's particular stage of development.

Figure 8:
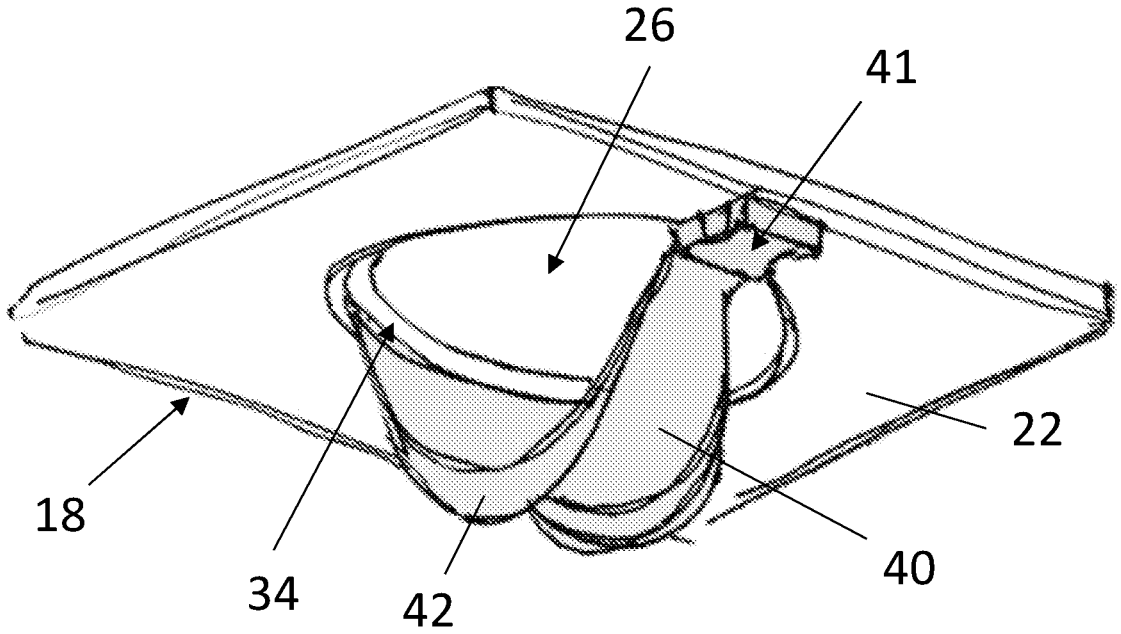
FIG. 8 is another perspective view of the seat assembly of the sit-to-stand convertible highchair in the standing configuration.
Figure 9:
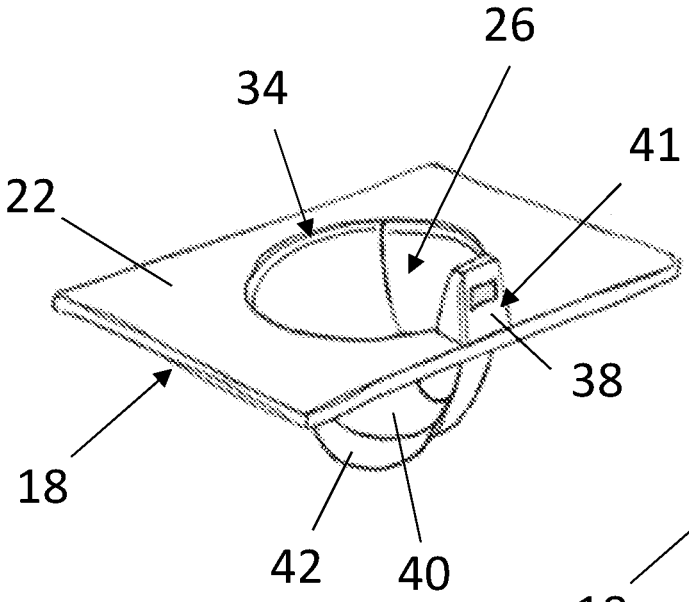
FIG. 9 is another perspective view of the seat assembly of the sit-to-stand convertible highchair in the standing configuration.
Figure 10:
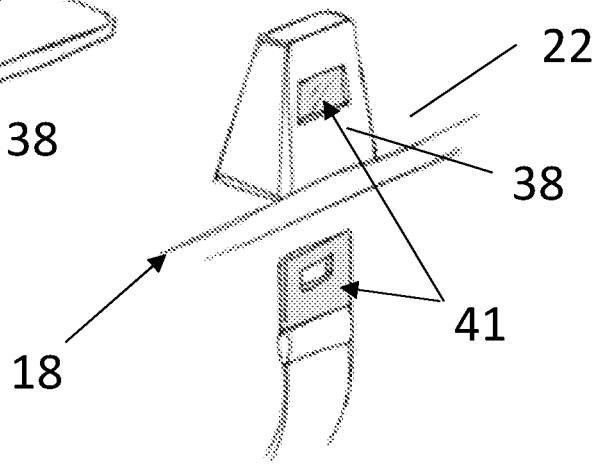
FIG. 10 is a perspective view of a crotch post of the seat assembly of the sit-to-stand convertible highchair.

In any embodiment, the seat assembly 14 may also include a crotch post 38 secured to the support surface 18, for example on the peripheral seat frame 22, for providing a barrier in front of the user when the user is sitting or standing in the highchair 10. The crotch post 38 may or may not be removable from the support surface 18. The crotch post 38 may also provide an anchor for securing a crotch strap 40 and a harness assembly 44. Specifically, with reference to FIGS. 8-10, the seat assembly 14 may include the crotch strap 40 secured to the support surface 18 at a first end of the crotch strap 40 and at a second end of the crotch strap 40. The crotch strap 40 is therefore configured to extend across the aperture 26 from the first end to the second end such that, when standing in the highchair 10, the user's legs may straddle the crotch strap 40. The seat assembly 14 may include a crotch strap holder for holding the crotch strap 40 up against the sitting surface 18 when not in use (e.g., when the highchair 10 is in the sitting configuration). The crotch strap 40 may be removably secured to the peripheral seat frame 22 at at least one of the first end or the second end of the crotch strap 40. Specifically, one or more ends of the crotch strap 40 may be removably attached to, for example, at least a portion of the periphery 34 of the aperture 26, the peripheral seat frame 22 itself, the backrest insert 36, and/or the crotch post 38. For example, at least one end of the crotch strap 40 may include a fixture 41 for removably attaching the crotch strap 40. The fixture 41 may be, for example, a buckle. The fixture 41 may be integrated into the crotch post 38, as depicted in FIGS. 9 and 10, or may be separately secured to the peripheral seat frame 22, as depicted in FIG. 8. The crotch strap 40 may be wholly removed from the seat assembly 14 for, for example, washing or replacing. The crotch strap 40 may be made of a soft and flexible material, such as fabric, and may have one or more wings 42 extending from the side edges thereof. The wings 42 may be provided, for example, for comfort of the user and to prevent chaffing on the user's legs.

Figure 11A:
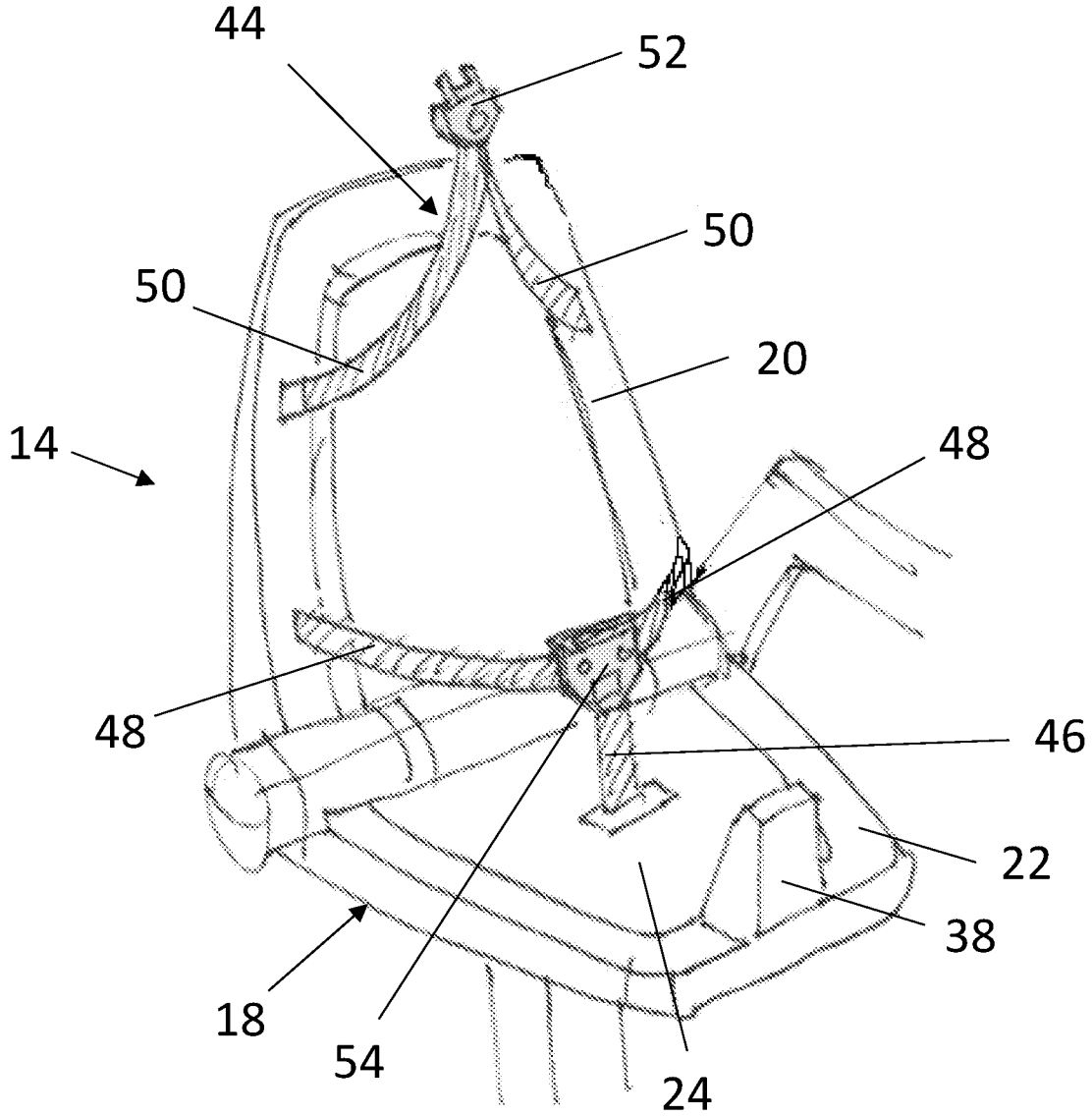
FIG. 11A is a perspective view of the seat assembly of the sit-to-stand convertible highchair.
Figure 11B:
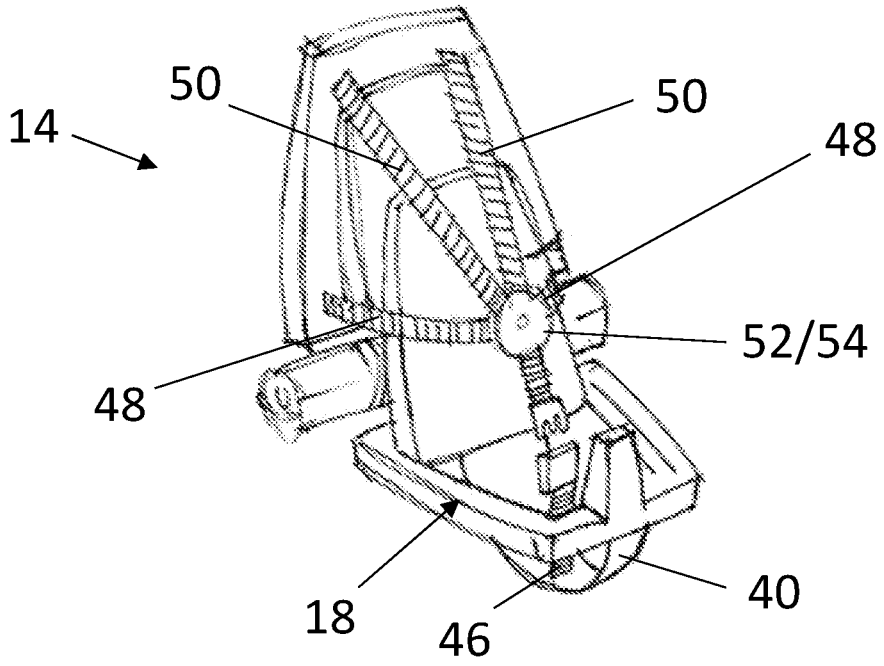
FIG. 11B is another perspective view of the seat assembly of the sit-to-stand convertible highchair.
Figure 11C:
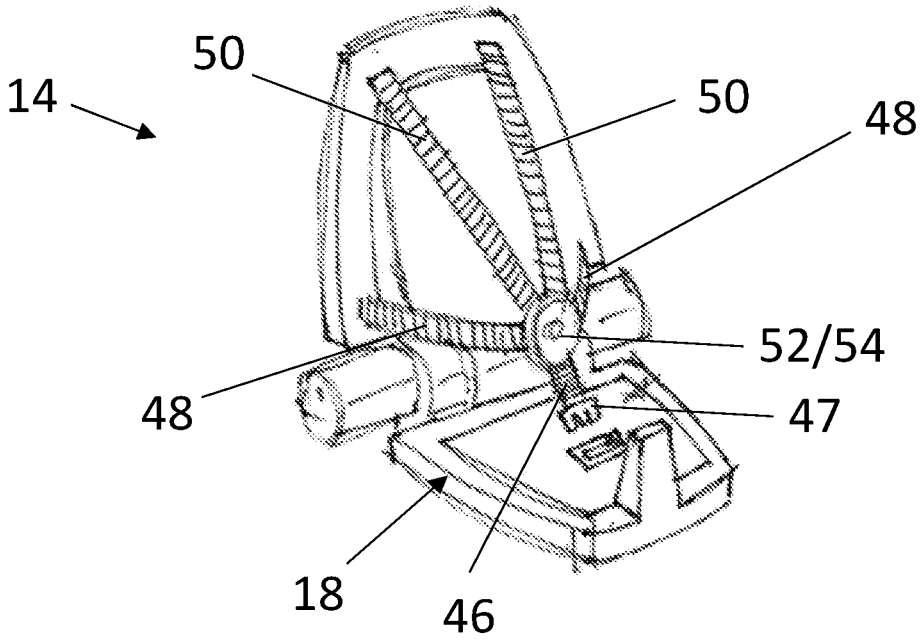
FIG. 11C is another perspective view of the seat assembly of the sit-to-stand convertible highchair.

With reference to FIGS. 11A-C, the harness assembly 44 includes a plurality of harness straps for securing the user in the seat assembly 14 of the highchair 10, and may be a 3-point or a 5-point assembly. For example, the harness assembly 44 includes at least one crotch harness strap 46, at least two waist harness straps 48, and at least two shoulder harness straps 50 (e.g., a 5-point harness assembly). In another embodiment, the harness assembly 44 may only include the at least one crotch harness strap 46 and the at least two waist harness straps 48 (e.g., a 3-point harness assembly). In the sitting configuration of the highchair 10 (FIGS. 11A and 11C), the at least one crotch harness strap 46 may be securely attached to the sitting surface 18 or the crotch post 38 at a first end of the at least one crotch harness strap 46. The at least one crotch harness strap 46 may be at least partially retractable into the sitting surface 18 or the crotch post 38 at the first end. In the standing configuration of the highchair 10 (FIG. 11B), the at least one crotch harness strap 46 may be securely attached to the crotch strap 40 or the sitting surface 18, specifically the peripheral seat frame 22, and may be at least partially retractable therein.

Each of the at least two waist harness straps 48 may be securely attached to the backrest 20 at a first end of each of the two waist harness straps 48. At least one of the at least two waist harness straps 48 may be at least partially retractable into the backrest 20. In the same way, each of the at least two shoulder harness straps 50 may be securely attached to the backrest 20 at a first end of each of the at least two shoulder harness straps 50. At least one of the at least two shoulder harness straps 50 may be at least partially retractable into the backrest 20. For example, one or more retracting mechanisms may be provided for pulling the waist harness strap(s) 48 and/or the shoulder harness strap(s) 50 into the backrest 20. Each of the at least two shoulder harness straps 50, the at least two waist harness straps 48 and the at least one crotch harness strap 46 may be removably attached to the backrest 20 and the sitting surface 18, the crotch post 38, and the crotch strap 40 respectively, for cleaning or replacement, for example.

Each of the at least two shoulder harness straps 50 may be independent from each other and may connect to each other at respective second ends thereof (the ends opposite the first ends that are securely attached to the backrest 20), such that they may, together, be removably connected to the at least two waist harness straps 48 and the at least one crotch harness strap 46 to secure the user in the highchair 10. For example, the at least two shoulder harness straps 50 may be connected to each other at their respective second ends with a shoulder strap fastener 52. The at least two shoulder harness straps 50, however, may be independently removably connected to the shoulder strap fastener 52. In the same way, the at least two waist harness straps 48 and the at least one crotch harness strap 46 may be independent from each other and may connect to each other at respective second ends thereof (the ends opposite the first ends that are securely attached to the backrest 20 and the sitting surface 18 or the crotch post 38, respectively), such that they may, together, be removably connected to the at least two shoulder harness straps 50. For example, the at least two waist harness straps 48 and the at least one crotch harness strap 46 may be connected to each other at their respective second ends with a waist strap fastener 54. The at least two waist harness straps 48 and the at least one crotch harness strap 46, however, may each be independently removably connected to the waist strap fastener 54. The waist strap fastener 54 and the shoulder strap fastener 52 may therefore removably connect to each other to secure the user in the highchair 10. That is, when the waist strap fastener 54 and the shoulder strap fastener 52 are connected, the user is securely retained in the highchair 10. When the waist strap fastener 54 and the shoulder strap fastener 52 are not connected, the shoulder strap fastener 52 and the at least two shoulder straps 50 may be moved over the user's head to enable the user to get out of the highchair 10. The crotch harness strap 46 may also be removably connected to the sitting surface 18 at the first end, as depicted in FIG. 11C, with a connector 47.

All or part of the harness assembly 44 may be removable for cleaning or moving to an alternative position on the highchair 10, for example to accommodate different sizes or heights of the child. For example, adjustment slots may be provided on the backrest 20 into which each of the two shoulder harness straps 50 may be secured to adjust a position of the two shoulder harness straps 50 relative to the user in the seat assembly 14. Additionally, the highchair 10 may include a strap storage means, such as slots, slits, magnets, or any other suitable storage means, with which the two shoulder harness straps 50 may be secured to keep the two shoulder harness straps 50 out of the way when not in use. It is understood that the harness assembly 44 described and depicted herein is provided as a non-limiting example and that variations and other suitable harness assembly configurations may be suitable for the harness assembly 44 of the highchair 10. For example, a cross-body harness may be used in the highchair 10. Additionally, the harness assembly 44 may include one or more pads along any one of the harness straps for increased comfort for the user and/or to address sensory sensitivities of the user.

Figure 12:
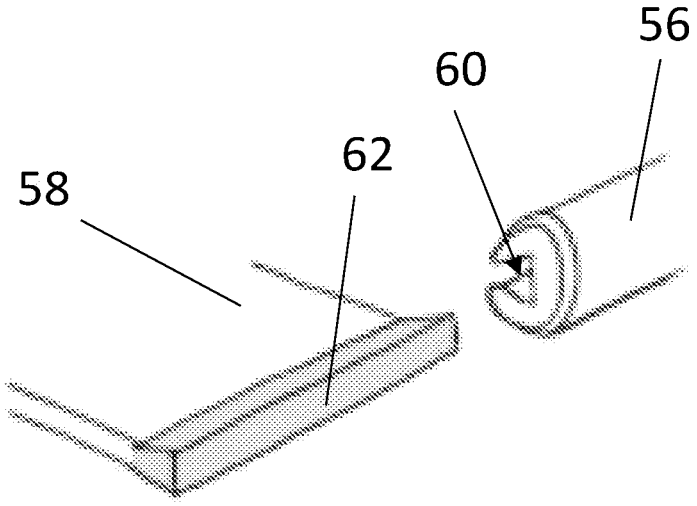
FIG. 12 is a perspective view of the at least one removable tray and armrest of the seat assembly of the sit-to-stand convertible highchair.
Figure 13:
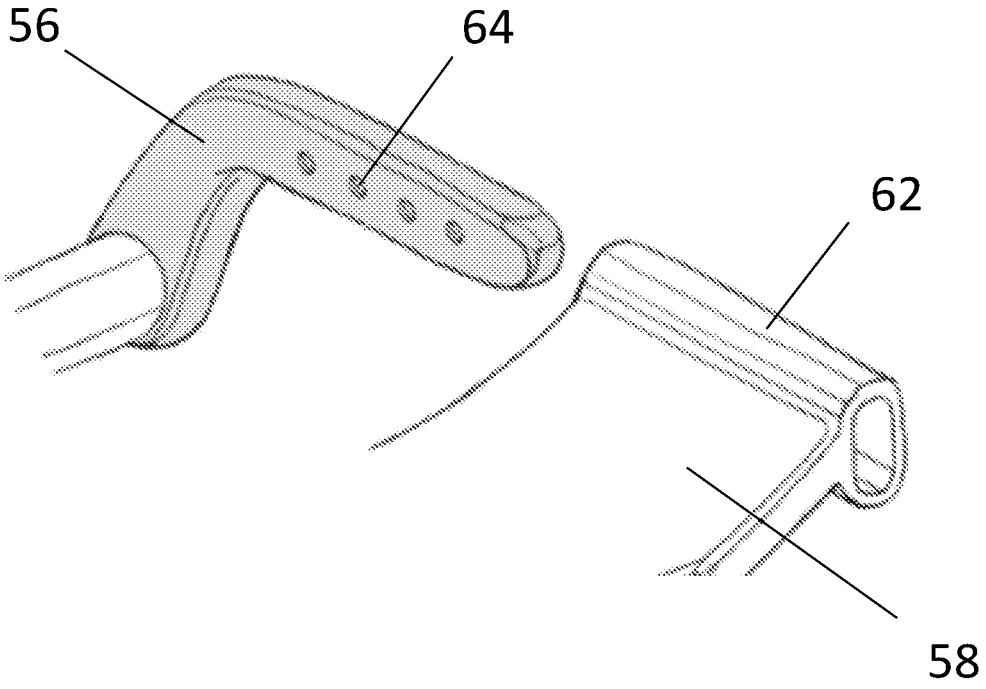
FIG. 13 is another perspective view of the at least one removable tray and armrest of the seat assembly of the sit-to-stand convertible highchair.

As depicted in FIGS. 1-2 and 7, the highchair 10 may include a plurality of armrests 56 each arranged on a respective lateral side of the seat assembly 14, and at least one removable tray 58 configured to extend between and variably engage the plurality of armrests 56. Specifically, the plurality of armrests 56 may include two armrests 56, each disposed on one lateral side of the seat assembly 14 and configured to support the at least one removable tray 58 therebetween. In one embodiment, with reference to FIG. 12, each of the plurality of armrests 56 may include an armrest groove 60 into which a lateral side 62 of the at least one removable tray 58 slides and fits into. For example, the armrest groove 60 and the lateral side 62 of the at least one removable tray 58 may have complementary shapes configured to support the at least one removable tray 58 securely in each of the plurality of armrests 56 when the at least one removable tray 58 is engaged with each of the plurality of armrests 56. It is understood that the complementary shapes depicted in FIG. 12 are provided as non-limiting examples and that other complementary shapes may be employed. The at least one removable tray 58 may be configured to slide inward and outward along the groove 60 such that the at least one removable tray 58 may be positioned closer to or further away from the child in the highchair 10, as desired.

Figure 14:
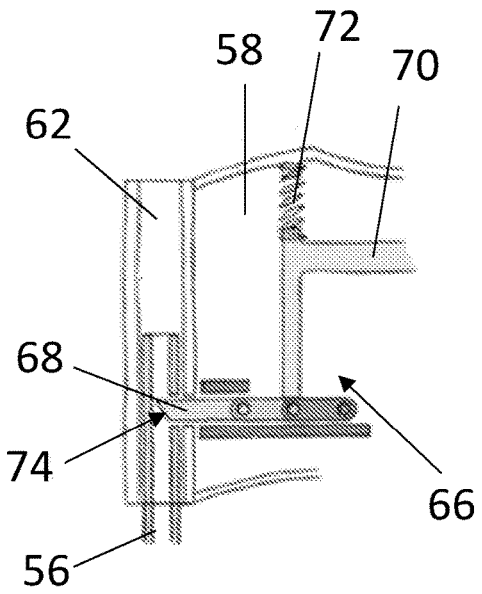
FIG. 14 is a cross-sectional view of the at least one removable tray and armrest of the seat assembly of the sit-to-stand convertible highchair.
Figure 15:
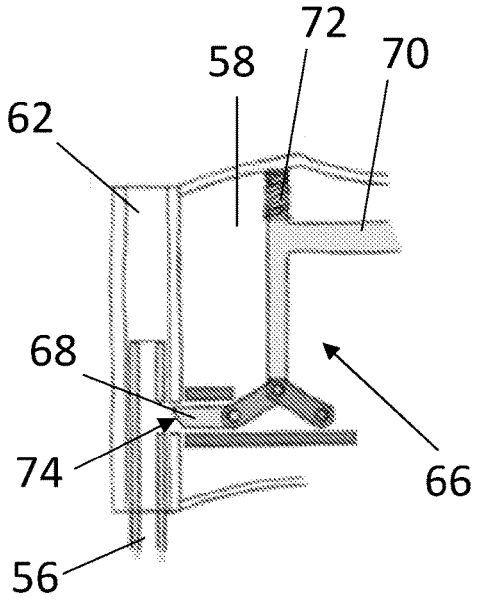
FIG. 15 is another cross-sectional view of the at least one removable tray and armrest of the seat assembly of the sit-to-stand convertible highchair.
Figure 16:
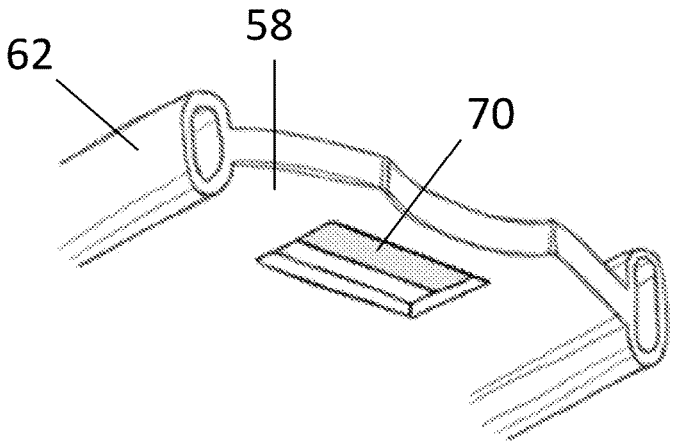
FIG. 16 is another perspective view of the at least one removable tray of the sit-to-stand convertible highchair.
Figure 17:
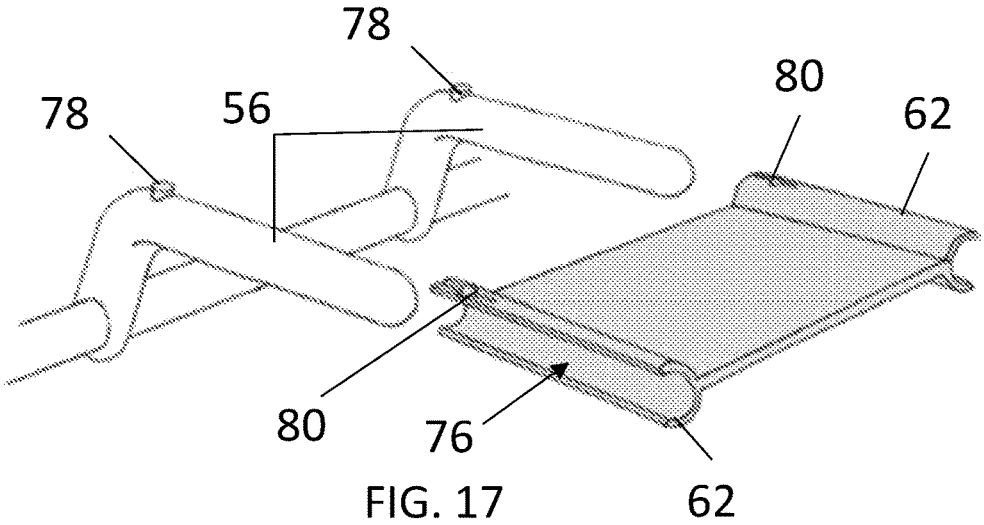
FIG. 17 is another perspective view of the at least one removable tray and armrests of the seat assembly of the sit-to-stand convertible highchair.
Figure 18:
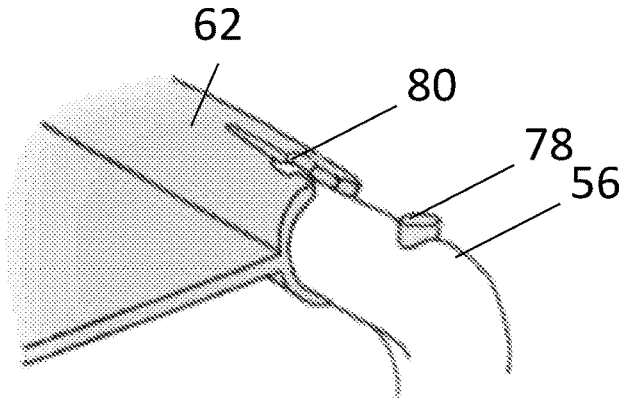
FIG. 18 is another perspective view of the at least one removable tray and armrest of the seat assembly of the sit-to-stand convertible highchair.

In another embodiment, depicted in FIGS. 13-16, each of the plurality of armrests 56 include a plurality of adjustment holes 64 spaced apart along each of the plurality of armrests 56, with which an integrated tray lock 66 of the at least one removable tray 58 may variably engage when the lateral sides 62 of the at least one removable tray 58 slide over each of the plurality of armrests 56. As depicted in FIGS. 14 and 15, for example, the integrated tray lock 66 may include a spring-loaded release lever 68 movable between a tray locked position (FIG. 14) and a tray released position (FIG. 15) by variably engaging a pull lever 70. As depicted in FIG. 16, the pull lever 70 is accessible by another user (a caregiver of the child), for example on a bottom surface of the at least one removable tray 58 toward a front of the at least one removable tray 58 where the user (the child) cannot reach. In the tray locked position (FIG. 14) of the spring-loaded release lever 68, a spring 72 of the integrated tray lock 66 biases the spring-loaded release lever 68 into engagement with one of the plurality of adjustment holes 64 of at least one of the plurality of armrests 56 to securely engage the at least one removable tray 58 with the at least one of the plurality of armrests 56. To disengage the at least one removable tray 58 with the at least one of the plurality of armrests 56, the spring-loaded release lever 68 may be moved to the tray released position (FIG. 15) by engaging the pull lever 70. In the tray released position (FIG. 15), the force of pulling the pull lever 70 causes the spring 72 to compress and release the bias on the spring-loaded release lever 68, such that the spring-loaded release lever 68 disengages the one of the plurality of adjustment holes 64. In the tray released position (FIG. 15), the at least one removable tray 58 is free to move toward or away from the user in the highchair 10, based on the number and position of the plurality of adjustment holes 64.

The spring-loaded release lever 68 may include a chamfered edge 74 where the spring-loaded release lever 68 engages each of the plurality of adjustment holes 64. Accordingly, when the at least one removable tray 58 is moved toward the user in the highchair 10, each of the plurality of armrests 56 may slide along the chamfered edge 74 and push the spring-loaded release lever 68 toward the tray released position (FIG. 15), allowing the at least one removable tray 58 to ratchet toward the user without engaging the pull lever 70. However, the at least one removable tray 58 is not able to move away from the user without engaging the pull lever 70.

In other embodiments, depicted in FIGS. 17-24, each lateral side 62 of the at least one removable tray 58 may include a tray groove 76 into which at least one of the plurality of armrests 56 slides and fits into. For example, the tray groove 76 and each of the plurality of armrests 56 may have complementary shapes configured to support the at least one tray securely around the at least one of the plurality of armrests 56 when the at least one removable tray 58 is engaged with the at least one of the plurality of armrests 56. It is understood that the complementary shapes depicted in FIGS. 17-24 are provided as non-limiting examples and that other complementary shapes may be employed. In these embodiments, the at least one removable tray 58 may be configured to slide inward and outward along the at least one of the plurality of armrests 56 by the at least one of the plurality of armrests 56 sliding in an out of the tray groove 76, such that the at least one removable tray 58 may be positioned closer to or further away from the child in the highchair 10, as desired.

Figure 19:
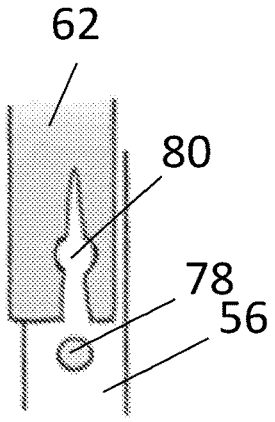
FIG. 19 is a top view of the at least one removable tray and armrest of the seat assembly of the sit-to-stand convertible highchair.
Figure 20:
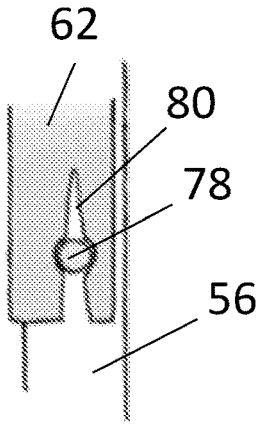
FIG. 20 is another top view of the at least one removable tray and armrest of the seat assembly of the sit-to-stand convertible highchair.
Figure 21:
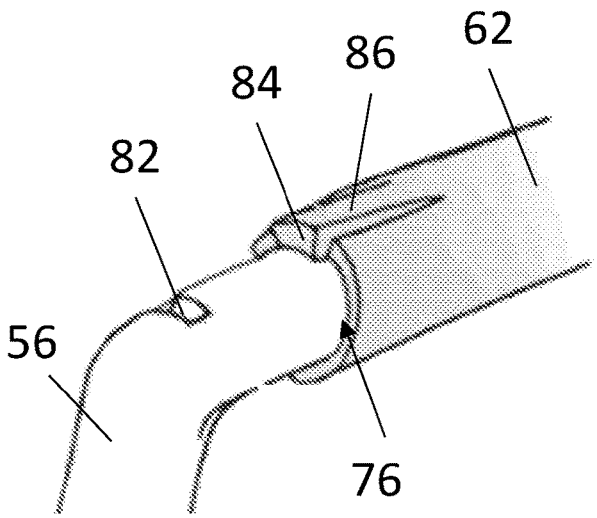
FIG. 21 is a perspective view of the at least one removable tray and armrest of the seat assembly of the sit-to-stand convertible highchair.
Figure 22:
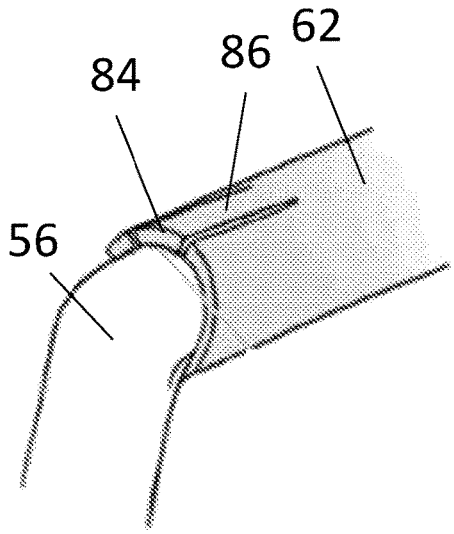
FIG. 22 is another perspective view of the at least one removable tray and armrest of the seat assembly of the sit-to-stand convertible highchair.

In the specific embodiment depicted in FIGS. 17-20, the at least one of the plurality of armrests 56 may include a lock catch 78 at a predetermined position on the at least one of the plurality of armrests 56 which is configured to variably engage an integrated lock catch recess 80 on the lateral side 62 of the at least one removable tray 58. Specifically, the lock catch 78 is configured to project out of the at least one of the plurality of armrests 56, and the integrated lock catch recess 80 is configured to variably engage the lock catch 78 to secure the at least one removable tray 58 to the at least one of the plurality of armrests 56. For example, the integrated lock catch recess 80 may be a slit formed in the lateral side 62 of the at least one removable tray 58, with a notch formed in the slit. The slit may be configured to resiliently expand over the lock catch 78 until the lock catch 78 reaches the notch formed in the slit and becomes captured by the notch. FIG. 19 depicts the at least one removable tray 58 in an unlocked position in which the lock catch 78 is not secured by the integrated lock catch recess 80, and FIG. 20 depicts the at least one removable tray 58 in a locked position in which the lock catch 78 is secured by the integrated lock catch recess 80.

Figure 23:
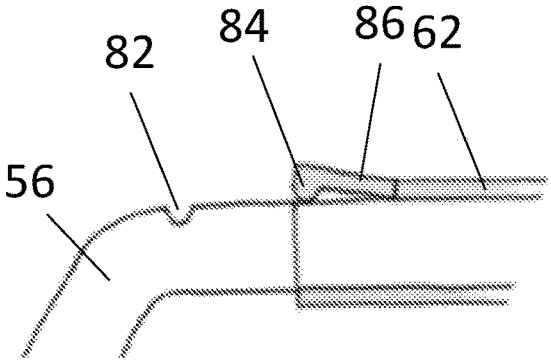
FIG. 23 is a cross-sectional view of the at least one removable tray and armrest of the seat assembly of the sit-to-stand convertible highchair.
Figure 24:
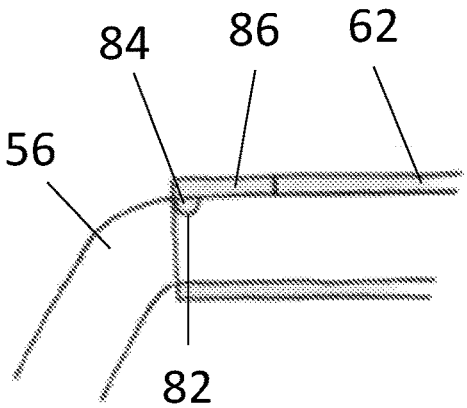
FIG. 24 is another cross-sectional view of the at least one removable tray and armrest of the seat assembly of the sit-to-stand convertible highchair.
Figure 25:
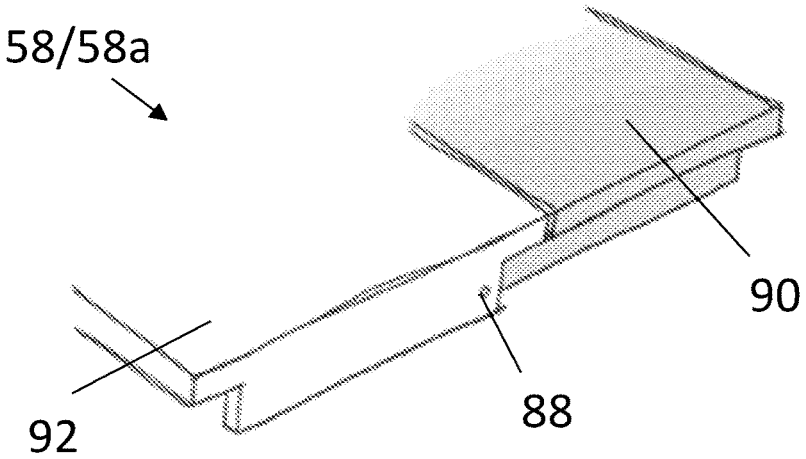
FIG. 25 is a perspective view of the at least one removable tray of the sit-to-stand convertible highchair.
Figure 26:
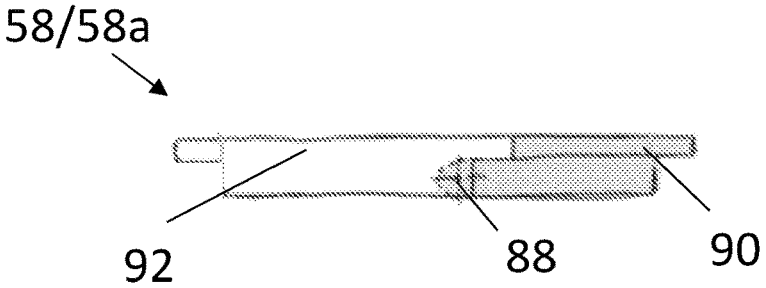
FIG. 26 is a side view of the at least one removable tray of the sit-to-stand convertible highchair.
Figure 27:
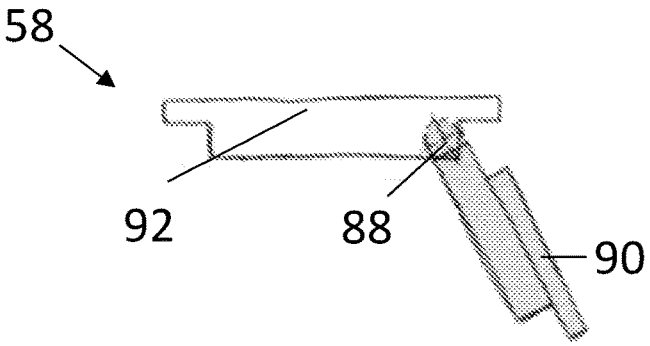
FIG. 27 is another side view of the at least one removable tray of the sit-to-stand convertible highchair.

In the other specific embodiment depicted in FIGS. 21-24 the at least one of the plurality of armrests 56 may include at least one integrated lock catch recess 82 at at least one predetermined position on the at least one of the plurality of armrests 56 which is configured to variably engage a lock catch 84 on the lateral side 62 of the at least one removable tray 58. Specifically, the lock catch 84 on the lateral side 62 of the at least one removable tray 58 may be positioned at a distal end of a resilient tab 86, and the integrated lock catch recess 82 is configured to variably engage the lock catch 84 to secure the at least one removable tray 58 to the at least one of the plurality of armrests 56. For example, as the lateral side 62 of the at least one removable tray 58 moves toward the user in the highchair 10 along the at least one of the plurality of armrests 56 toward the integrated lock catch recess 82, the lock catch 84 is configured to be captured by the integrated lock catch recess 82. To disengage the at least one removable tray 58 with the at least one of the plurality of armrests 56, the resilient tab 86 may be lifted to disengage the lock catch 84 with the integrated lock catch recess 82. FIG. 23 depicts the at least one removable tray 58 in an unlocked position in which the lock catch 84 is not secured by the integrated lock catch recess 82, and FIG. 24 depicts the at least one removable tray 58 in a locked position in which the lock catch 84 is secured by the integrated lock catch recess 82.

Additionally or alternatively, the at least one removable tray 58 may be attached to the plurality of armrests 56 with an alternative or additional suitable attachment, such as for example magnets which are strong enough such that the user is unable to remove the at least one removable tray 58 when secured to the plurality of armrests 56. It is understood that these attachment means are provided as non-limiting examples, and that other suitable means may be used to attach the at least one removable tray 58 to the plurality of armrests 56. Additionally, the at least one removable tray 58 may be attached to the plurality of armrests 56 in a manner that allows vertical adjustability of the at least one removable tray 58 relative to the sitting surface 18. It is also understood that the highchair 10 may be used with or without the at least one removable tray 58 attached, for example when pushed up to a table.

Figure 28:
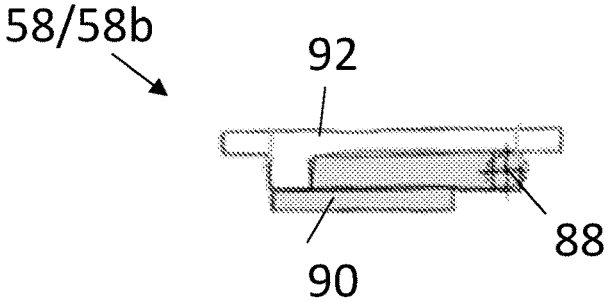
FIG. 28 is another sideview of the at least one removable tray of the sit-to-stand convertible highchair.

The at least one removable tray 58 may include two removable trays, each being of a different size. For example, a first removable tray may be a larger tray having a first lateral width, and a second removable tray may be a smaller tray having a second lateral width that is less than the first lateral width. Additionally or alternatively, as depicted in FIGS. 25-28, the at least one removable tray 58 may be foldable such that it is configurable as either the larger tray **58*a* or the smaller tray 58*b*. As depicted, the at least one removable tray 58 may include a tray hinge 88 operable to fold the at least one removable tray 58 such that one portion 90 of the at least one removable tray 58 folds underneath another portion 92 of the at least one removable tray 58, converting the at least one removable tray 58 from the larger tray 58***a* (FIGS. 25 and 26) to the smaller tray 58*b* (FIG. 28). Both the larger tray 58*a* and the smaller tray 58*b* are attachable to the plurality of armrests 56 at respective lateral sides 62 thereof, according to any of the above-described embodiments. At least one of the at least one removable tray 58 may include a removable tray topper that is configured to be easily removed from the at least one removable tray 58 for washing. The removable tray topper may be, for example, dishwasher safe.

Figure 29:
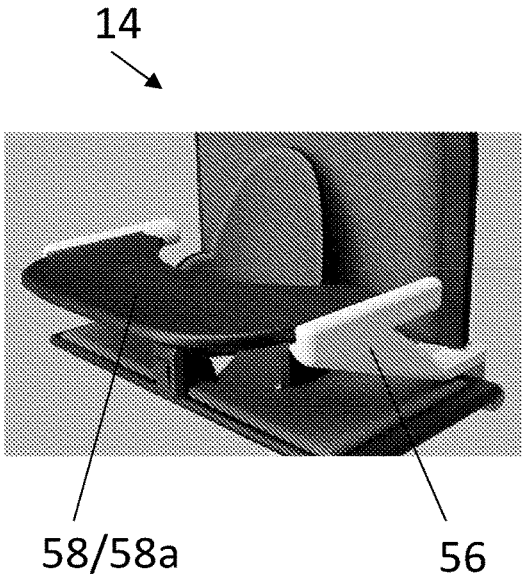
FIG. 29 is a perspective view of the seat assembly of the sit-to-stand convertible highchair.
Figure 30:
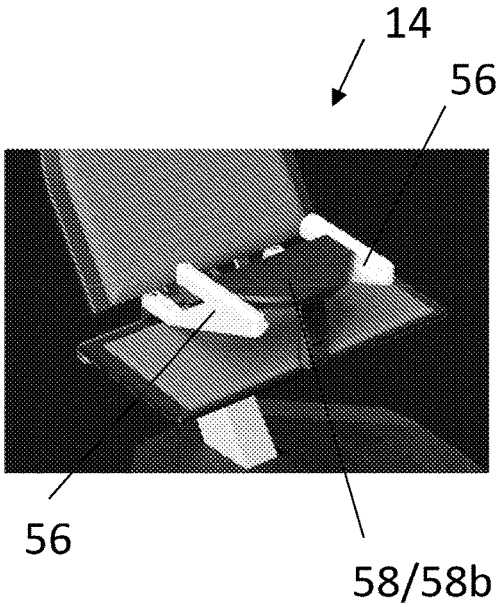
FIG. 30 is another perspective view of the seat assembly of the sit-to-stand convertible highchair.

The first and second removable tray 58 may be interchangeable in the highchair 10 and the plurality of armrests 56 may be configured to accommodate and support both the first and second removable tray 58. That is, at least one of the plurality of armrests 56 are movable to variably engage and accommodate the at least one removable tray 58. For example, at least one of the plurality of armrests 56 may be pivotably and/or slidably mounted to the seat assembly 14 such that they may pivot, laterally and/or vertically, and/or slide laterally relative to the seat assembly 14. For example, as depicted in FIGS. 29 and 30, at least one of the plurality of armrests 56 may be slidably mounted to the seat assembly 14 such that the plurality of armrests 56 may be moved to accommodate and support various sizes of the at least one removable tray 58 (e.g., the larger tray 58*a* as depicted in FIG. 29 and the smaller tray 58*b* as depicted in FIG. 30).

Figure 31:
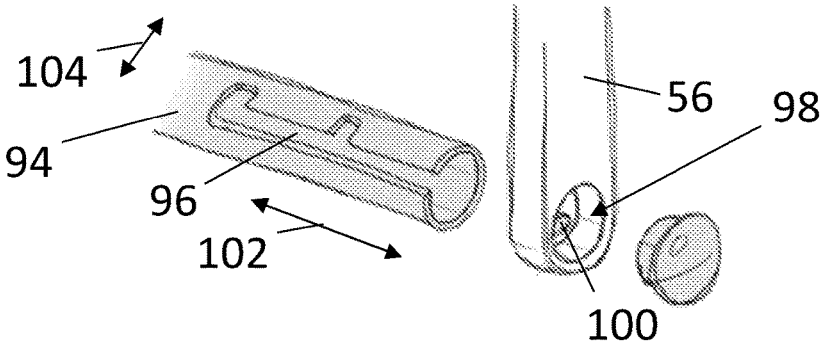
FIG. 31 is an exploded perspective view of a support rod and armrest of the sit-to-stand convertible highchair.
Figure 32:
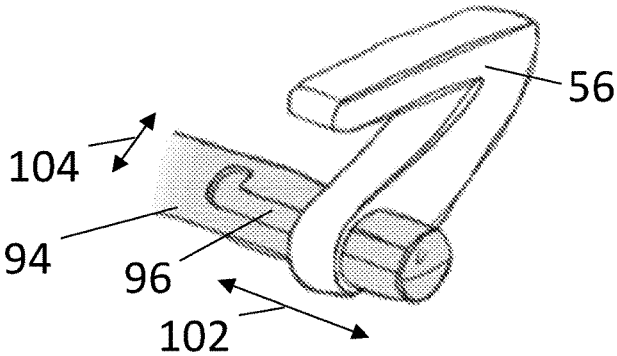
FIG. 32 is a perspective view of the support rod and armrest of the sit-to-stand convertible highchair.
Figure 33:
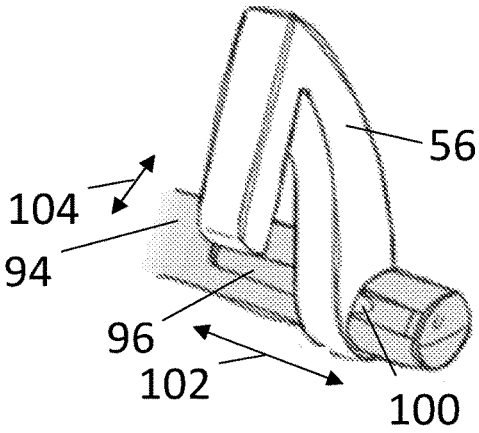
FIG. 33 is another perspective view of the support rod and armrest of the sit-to-stand convertible highchair.

At least one of the plurality of armrests 56 may be vertically pivotably mounted to the seat assembly 14 such that the at least one of the plurality of armrests 56 may vertically pivot relative to the seat assembly 14. Specifically, as depicted in FIGS. 31-33, at least one of the plurality of armrests 56 may be mounted on a support rod 94 including a recessed track 96 in which the at least one of the plurality of armrests 56 is configured to slide to accommodate various sizes of the at least one removable tray 58. That is, the at least one of the plurality of armrests 56 may include a support rod connection hole 98 for sliding over the support rod 94 and a guide tab 100 extending therefrom that is configured to engage with the recessed track 96 of the support rod 94. The recessed track 96 of the support rod 94 may extend both laterally, depicted by direction arrow 102 in FIGS. 31-33 (allowing the guide tab 100 to slide laterally relative thereto) and/or transversely, depicted by direction arrow 104 in FIGS. 31-33 (allowing the guide tab 100 to slide transversely, thereby allowing the at least one of the plurality of armrests 56 to vertically pivot relative to the seat assembly 14). The recessed track 96 may extend transversely at predetermined positions along the support rod 94 to accommodate and support the larger tray 58*a* and smaller tray 58*b*, respectively. FIG. 32 depicts the at least one of the plurality of armrests 56 in a pivoted-down position to accommodate the larger tray 58*a*, and FIG. 33 depicts the at least one of the plurality of armrests 56 in a pivoted-up position such that it is movable in the transverse direction.

Figure 34:
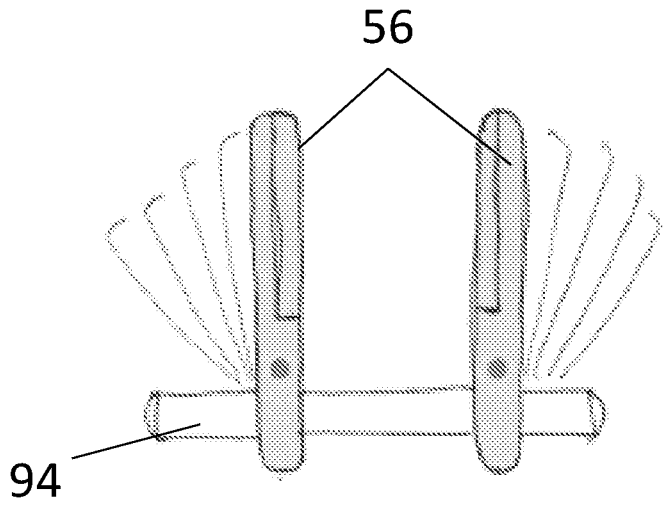
FIG. 34 is a top view of the support rod and armrests of the sit-to-stand convertible highchair.
Figure 35:
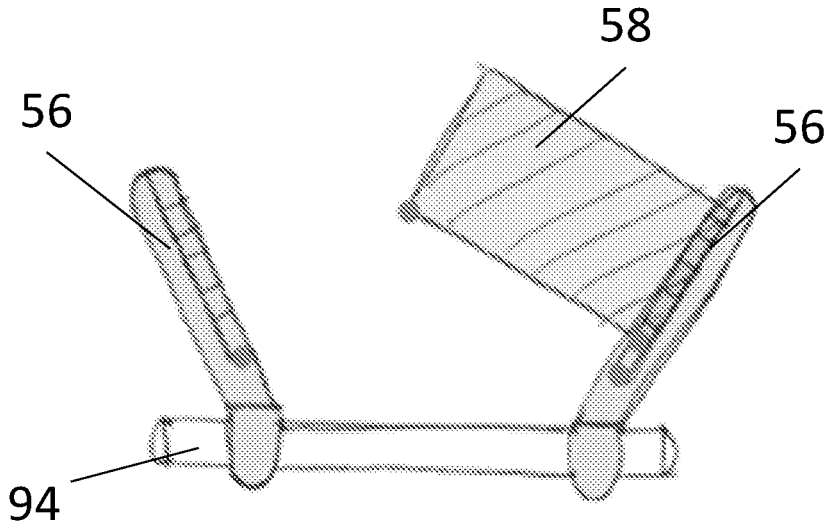
FIG. 35 is another top view of the support rod and armrests of the sit-to-stand convertible highchair.

With reference to FIGS. 34 and 35, at least one of the plurality of armrests 56 may additionally or alternatively be laterally pivotably mounted to the seat assembly 14 such that the at least one of the plurality of armrests 56 may laterally pivot relative to the seat assembly 14. In this manner, the at least one of the plurality of armrests 56 is configured to pivot laterally outward and inward, either with the at least one removable tray 58 attached (FIG. 35) or with the at least one removable tray 58 detached (FIG. 34). The variety of movement of the at least one of the plurality of armrests 56 allows for greater convenience and ease when moving a user into and out of the highchair 10, as well as for the variable accommodation and support of the at least one removable tray 58.

Figure 36:
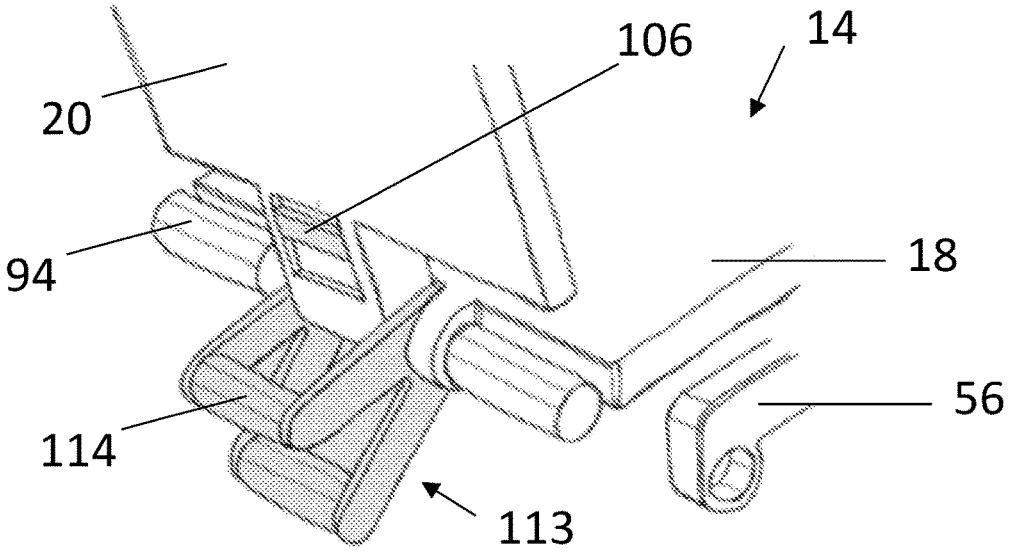
FIG. 36 is a perspective view of the seat assembly of the sit-to-stand convertible highchair.
Figure 37:
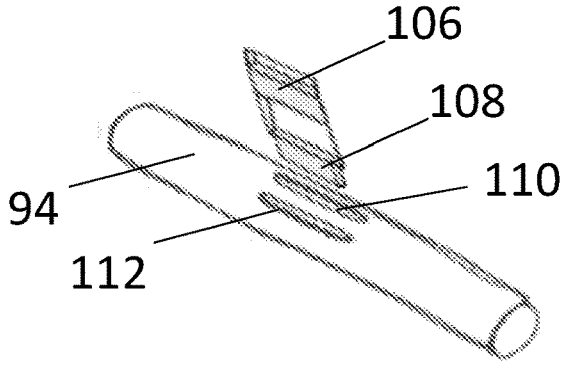
FIG. 37 is a perspective view of the support rod of the sit-to-stand convertible highchair.

Turning to FIGS. 36 and 37, each of the plurality of armrests 56, the support surface 18 of the seat assembly 14, and the backrest 20 of the seat assembly 14 may be supported on the support rod 94, such that the entire seat assembly 14 including the plurality of armrests 56 are movable together along the frame 12. The backrest 20 may be pivotably mounted to the support rod 94 such that it can recline relative to the support surface 18. Specifically, the backrest 20 may include a spring-loaded slide lever 106 accessible by the other user (the caregiver of the child) on a back of the backrest 20 to variably move a projection 108 of the backrest 20 into and out of engagement with one of a plurality of slots in the support rod 96 for variably reclining the backrest 20 relative to the support surface 18. That is, the spring-loaded slide lever 106 may be configured to bias the projection 108 into engagement with one of the plurality of slots in the support rod 94. When the spring-loaded slide lever 106 is pulled, the projection 108 is moved out of engagement with the one of the plurality of slots and is free to move to another one of the plurality of slots. For example, a first slot 110 may be positioned on the support rod 94 to enable the backrest 20 to be upright relative to the support surface 18 when the projection 108 is engaged with the first slot 110, and one or more additional slots 112 are positioned on the support rod 94 to enable the backrest 20 to be in one or more reclined positions relative to the support surface 18 when the projection 108 is engaged with the one or more additional slots 112. It will be understood that the backrest 20 may recline relative to the support surface 18 in another manner.

Both the seat assembly 14 (including the plurality of armrests 56) and the foot platform 16 are independently or commensurately adjustable along the frame 12, specifically along the post 13 of the frame 12, in the vertical direction to accommodate different heights and positions of the highchair 10. The post 13 may have markers, such as consecutive numbers or letters, along the vertical direction of the post 13 for identifying different positions along the post 13. Therefore, for example, a user may establish one or more personalized positions for one or both of the seat assembly 14 and the foot platform 16 corresponding to respective markers along the post 13, based on the user's size and/or desired height and position of the highchair 10 (e.g., when the highchair 10 is pushed up to a table, with or without the at least one removable tray 58 attached vs. when the highchair 10 is freestanding).

Figure 38:
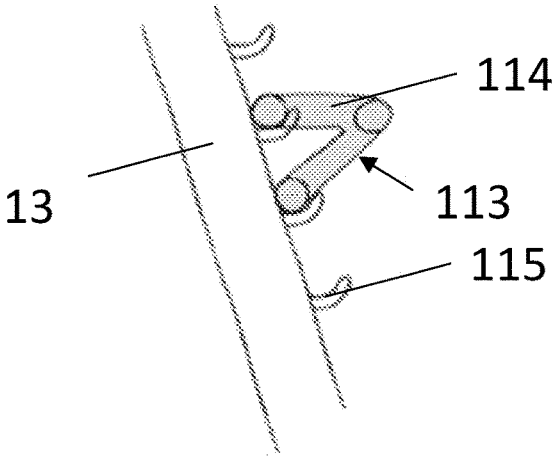
FIG. 38 is a side cross-sectional view of a post and an integrated mating feature of the sit-to-stand convertible highchair.

At least one of the seat assembly 14 and the foot platform 16 may include an integrated mating feature 113 configured to variably secure the at least one of the seat assembly 14 and the foot platform 16 to the post 13. The integrated mating feature 113 of the seat assembly 14 may be, for example, on the support rod 96 on which the seat assembly 14 is supported. For example, as depicted in FIG. 36, the integrated mating feature may be in the form of an adjustment support 114 permanently attached to and extending from the support rod 96. With additional reference to FIG. 38, the post 13 may include a plurality of adjustment support hooks 115 disposed along a vertical direction of the post 13 for accepting the adjustment support 114 and supporting the adjustment support 114, support rod 96 and seat assembly 14 at various heights along the post 13.

Figure 39:
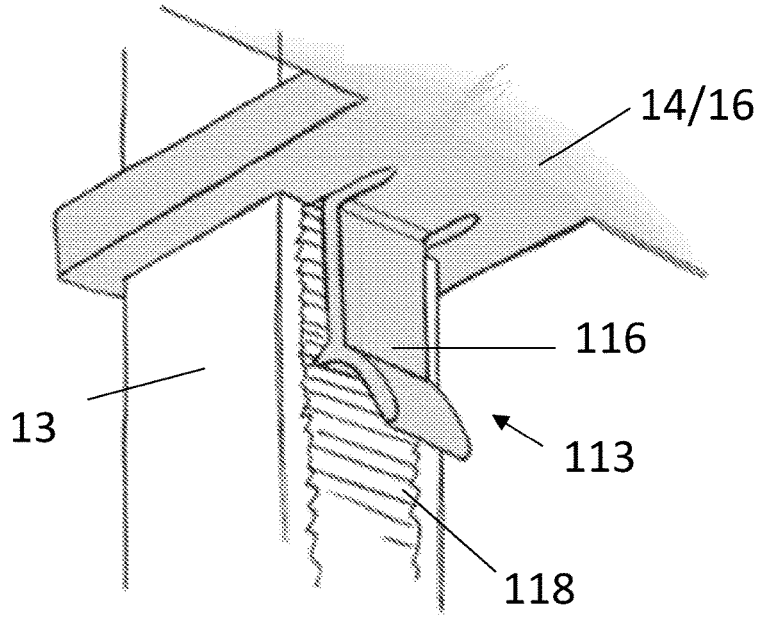
FIG. 39 is a perspective view of the post and the integrated mating feature of the sit-to-stand convertible highchair.
Figure 40:
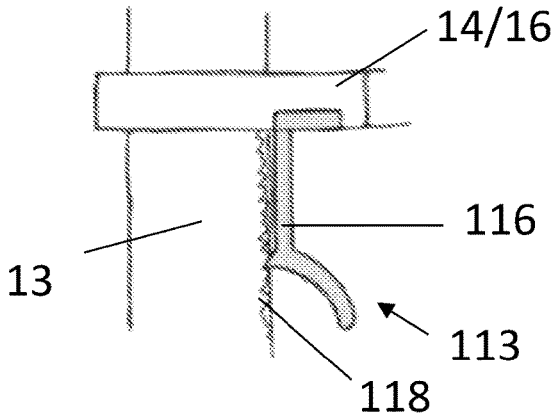
FIG. 40 is a side view of the post and the integrated mating feature of the sit-to-stand convertible highchair.
Figure 41:
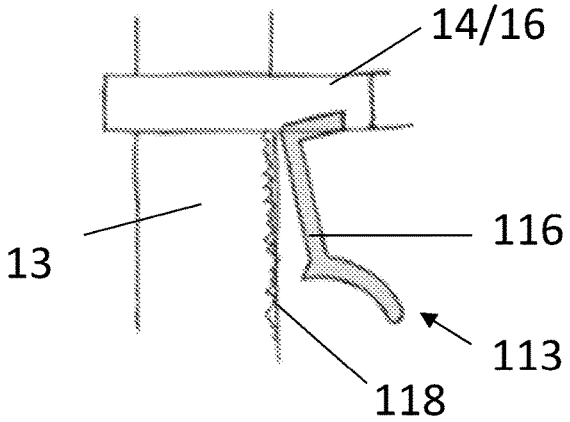
FIG. 41 is another side view of the post and the integrated mating feature of the sit-to-stand convertible highchair.
Figure 42:
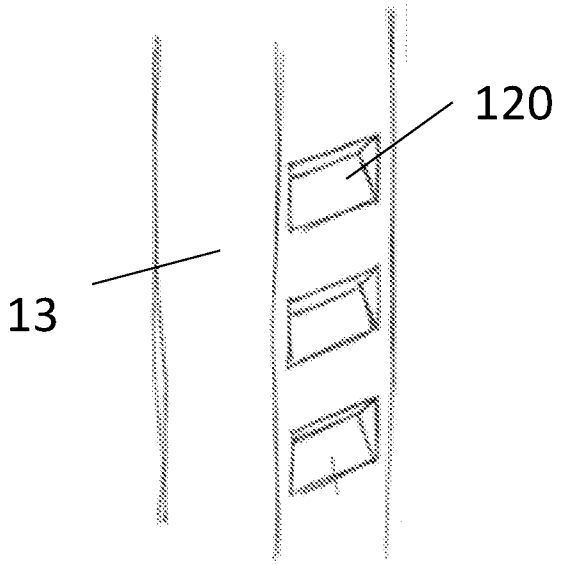
FIG. 42 is a perspective view of the post of the sit-to-stand convertible highchair.
Figure 43:
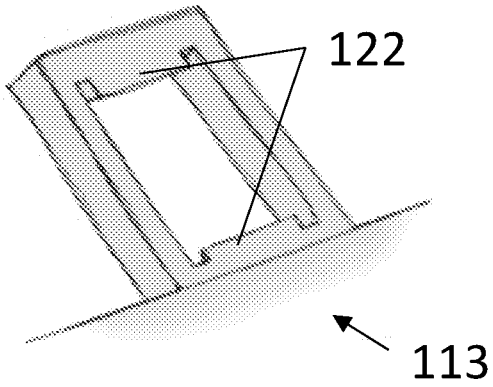
FIG. 43 is a perspective view of the integrated mating feature of the sit-to-stand convertible highchair.
Figure 44:
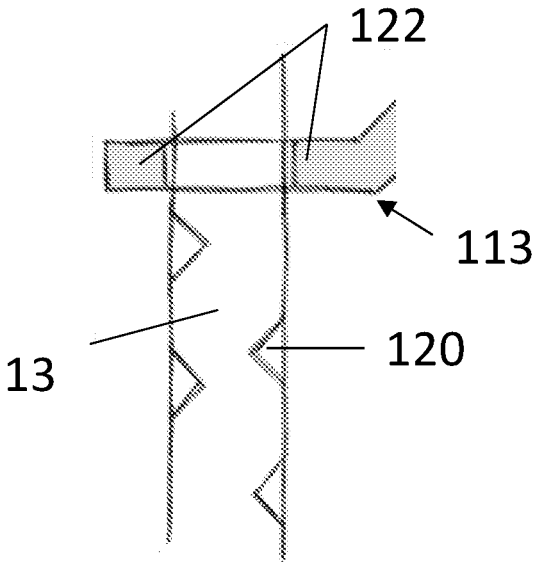
FIG. 44 is a side cross-sectional view of the post and the integrated mating feature of the sit-to-stand convertible highchair.
Figure 45:
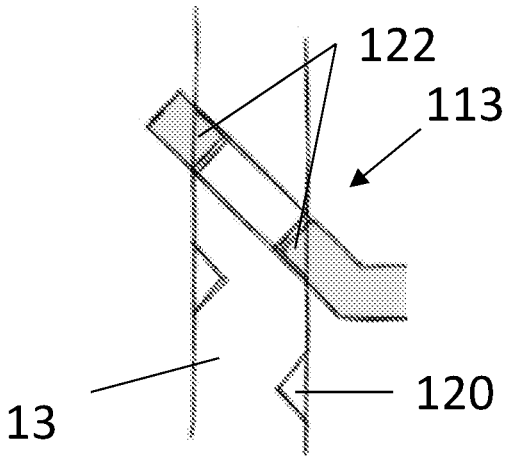
FIG. 45 is another side cross-sectional view of the post and the integrated mating feature of the sit-to-stand convertible highchair.

In another embodiment, depicted in FIGS. 39-41, the integrated mating feature may include an adjustment latch 116 integrated with at least one of the seat assembly 14 and foot platform 16. The post 13 may include a plurality of notches 118 disposed along a vertical direction of the post 13 for releasably engaging with the adjustment latch 116 and supporting the at least one of the seat assembly 14 and the foot platform 16 at various heights and positions along the post 13. The adjustment latch 116 may be resiliently integrated with the at least one of the seat assembly 14 and the foot platform 16 such that the adjustment latch 116 may be biased toward engagement with one of the plurality of notches 118 (FIGS. 39 and 40) and may be pulled and flexed away from engagement with the one of the plurality of notches 118 (FIG. 41) to enable movement of the at least one of the seat assembly 14 and the foot platform 16. The plurality of notches 118 may be angled such that when the adjustment latch 116 is engaged with one of the plurality of notches 118, the downward force of gravity and of the user on the seat assembly 14 and foot platform 16 helps secure the adjustment latch 116 into the one of the plurality of notches 118.

In another embodiment, depicted in FIGS. 42-45, the post 13 may include a plurality of geometric recesses 120 disposed along the vertical direction of the post 13, and the integrated mating feature 113 may include at least one corresponding geometric projection 122 configured to variably engage at least one of the plurality of geometric recesses 120. For example, as depicted, the post 13 may include the plurality of geometric recesses 120 on at least one side of the post 13. The integrated mating feature 113 may be configured to slide over and surround the post 13 and have the at least one corresponding geometric projection 122 opposing the at least one side of the post 13 having the plurality of geometric recesses 120. In this manner, the integrated mating feature 113 is configured to move freely vertically relative to the post 13 when in a first position (FIG. 44), in which the at least one corresponding geometric projection 122 is disengaged with the at least one of the plurality of geometric recesses 120. When the integrated mating feature 113 is tilted to a second position (FIG. 45), the at least one corresponding geometric projection 122 is configured to engage with the at least one of the plurality of geometric recesses 120. In the second position (FIG. 45) of the integrated mating feature 113, the downward force of gravity and of the user on the seat assembly 14 and the foot platform 16 helps secure the at least one corresponding geometric projection 122 in engagement with the at least one of the plurality of geometric recesses 120.

Figure 46:
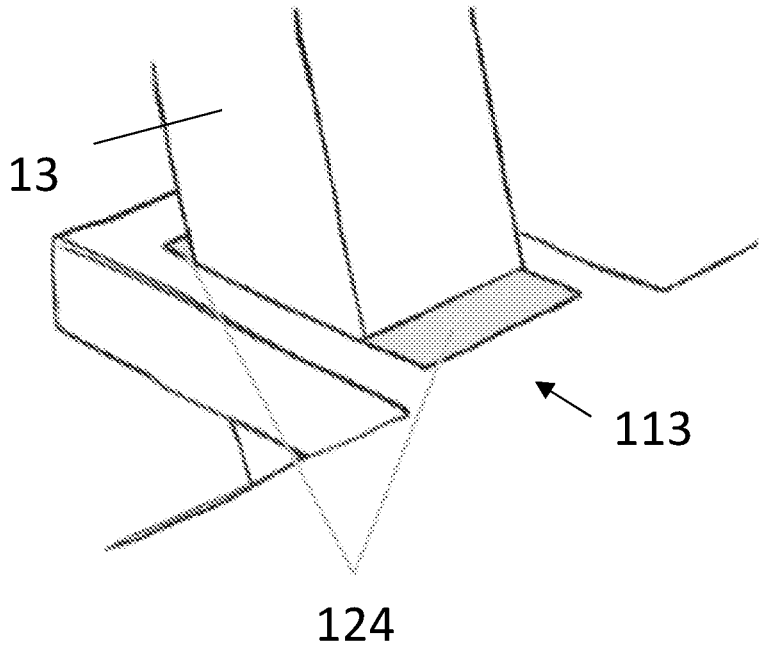
FIG. 46 is a perspective view of the post and the integrated mating feature of the sit-to-stand convertible highchair.
Figure 47:
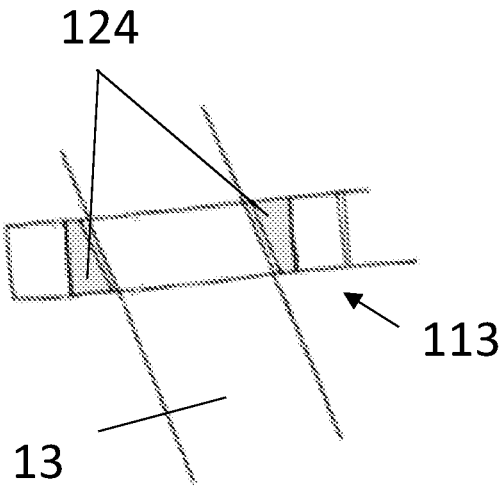
FIG. 47 is a side cross-sectional view of the post and the integrated mating feature of the sit-to-stand convertible highchair.
Figure 48:
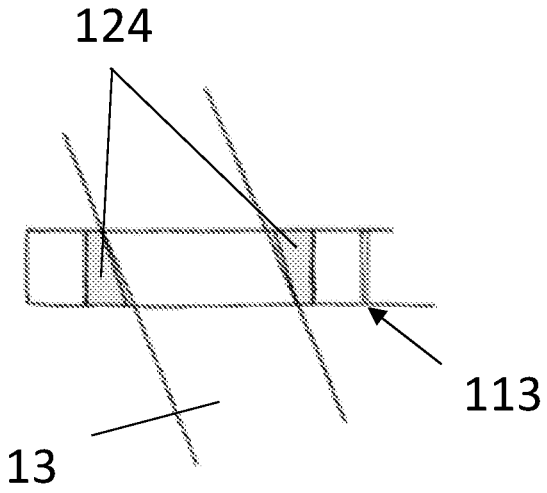
FIG. 48 is another side cross-sectional view of the post and the integrated mating feature of the sit-to-stand convertible highchair.

In another embodiment depicted in FIGS. 46-48, the integrated mating feature 113 may include at least one angled rubber wedge 124 configured to oppose the post 13. Specifically, as for the previously described embodiment, the integrated mating feature 113 may be configured to slide over and surround the post 13, such that each of the at least one angled rubber wedge 124 oppose the post 13. In this manner, when the integrated mating feature 113 is tilted upward relative to the post 13 in a first position (FIG. 47) such that the angled face of the at least one angled rubber wedge 124 is parallel to the surface of the post 13, the at least one angled rubber wedge 124 is configured to freely move relative to the post 13, allowing the integrated mating feature 113 to freely vertically move relative to the post 13. However, when the integrated mating feature 113 is tilted downward relative to the post 13 in a second position (FIG. 48) such that the angled face of the at least one angled rubber wedge 124 engages the post 13, the integrated mating feature 113 is fixed in place on the post 13. It will be understood that the post 13 may include one or more recesses or indentations for receiving the at least one angled rubber wedge 124 when the integrated mating feature 113 is in the second position. In the second position, the downward force of gravity and of the user on the seat assembly 14 and the foot platform 16 helps secure the at least one angled rubber wedge 124 and the integrated mating feature 113 in place relative to the post 13.

It is understood that the above described and depicted embodiments of the integrated mating feature 113 are provided as non-limiting examples, and that other mechanisms of variably securing the at least one of the seat assembly 14 and the foot platform 16 to the post may be employed. For example, the post 13 may include projections extending therefrom on one or more sides of the post 13 and the integrated mating feature 113 may include corresponding hooks configured to engage the projections on the post 13. Additionally, the integrated mating feature 113 may variably engage the post 13 by any conventional fastening means, such as by bolts or screws.

Figure 49:
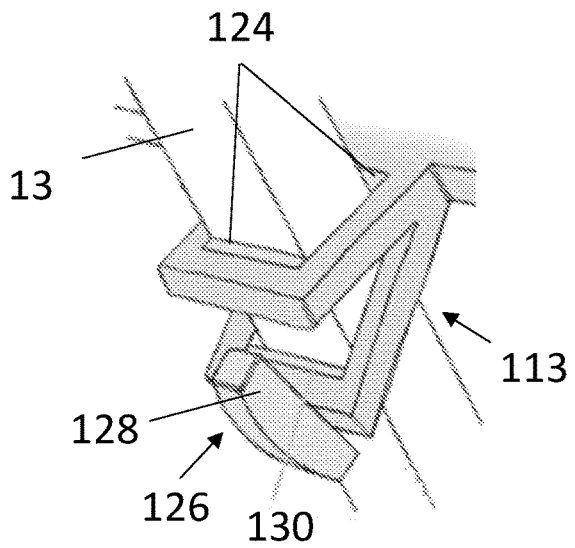
FIG. 49 is a perspective view of the post, integrated mating feature and compression lock of the sit-to-stand convertible highchair.
Figure 50:
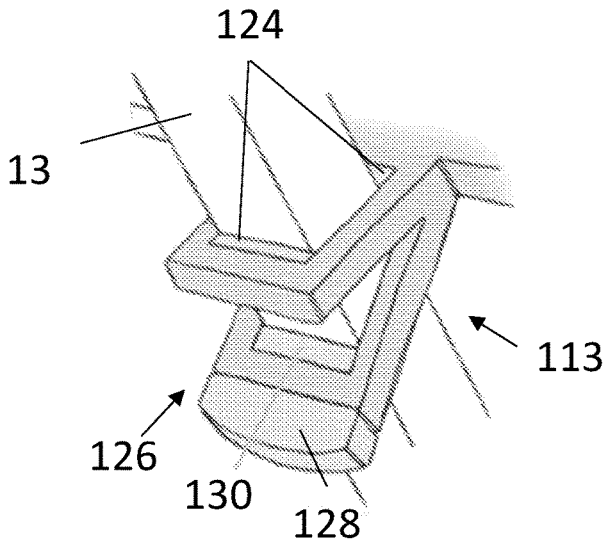
FIG. 50 is another perspective view of the post, integrated mating feature and compression lock of the sit-to-stand convertible highchair.
Figure 51:
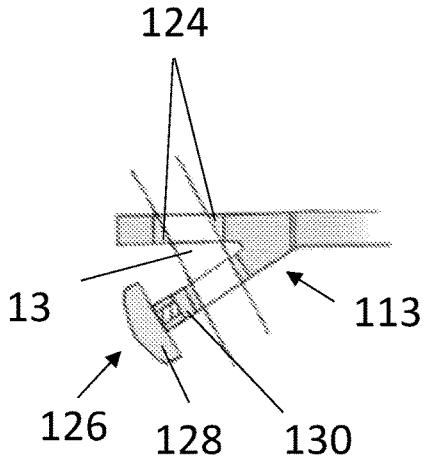
FIG. 51 is a side cross-sectional view of the post, integrated mating feature and compression lock of the sit-to-stand convertible highchair.
Figure 52:
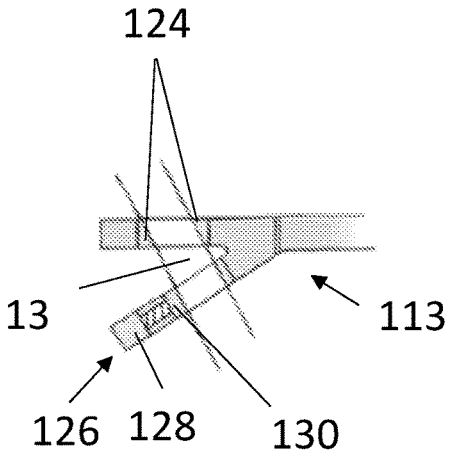
FIG. 52 is another side cross-sectional view of the post, integrated mating feature and compression lock of the sit-to-stand convertible highchair.
Figure 53:
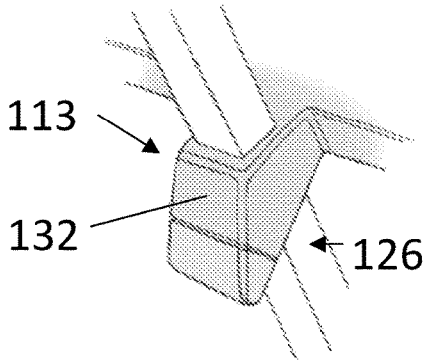
FIG. 53 is a perspective view of the post, integrated mating feature and compression lock of the sit-to-stand convertible highchair.
Figure 54:
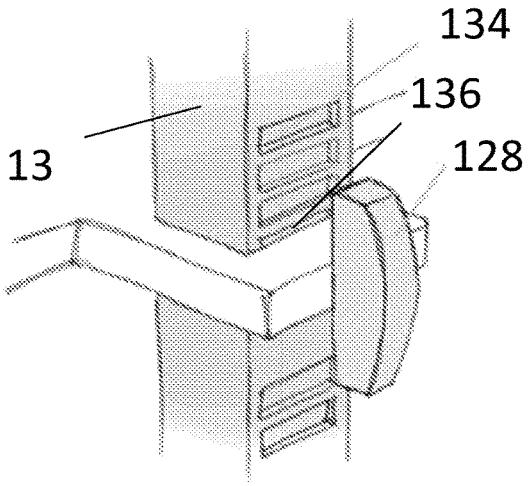
FIG. 54 is a perspective view of the post, integrated mating feature and compression lock of the sit-to-stand convertible highchair.
Figure 55:
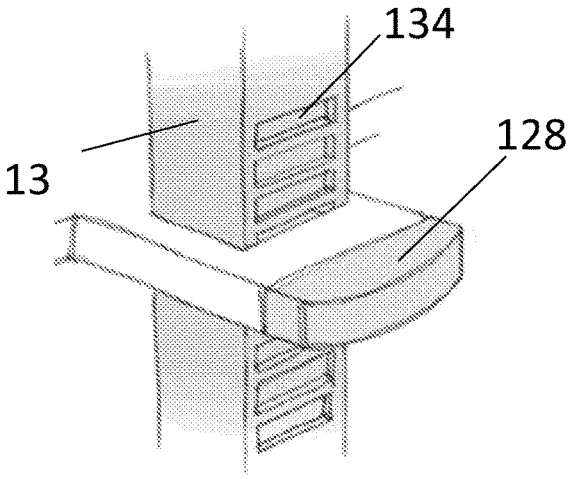
FIG. 55 is another perspective view of the post, integrated mating feature and compression lock of the sit-to-stand convertible highchair.
Figure 56:
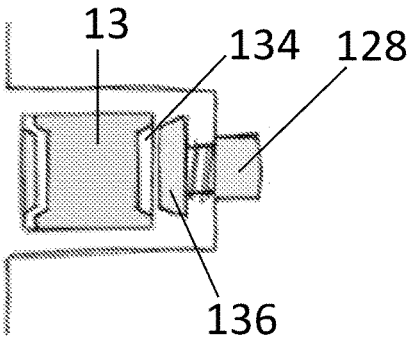
FIG. 56 is a side cross-sectional view of the post, integrated mating feature and compression lock of the sit-to-stand convertible highchair.
Figure 57:
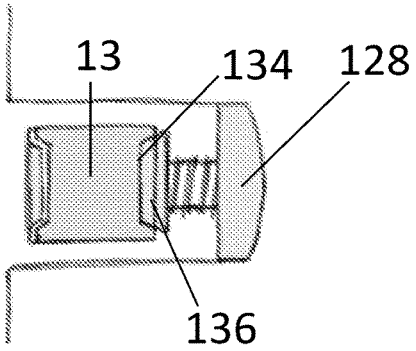
FIG. 57 is another side cross-sectional view of the post, integrated mating feature and compression lock of the sit-to-stand convertible highchair.

In any embodiment, the integrated mating feature 113 may include a compression lock 126 configured to move between an unlocked position, in which the integrated mating feature 113 is able to move relative to the post 13, and a locked position, in which the integrated mating feature 113 is unable to move relative to the post 13. The compression lock 126 may be configured to provide a tactile or audible feedback when switching between the unlocked position and the locked position. For example, with reference to FIGS. 49-52, an exemplary compression lock 126 is depicted in combination with the embodiment of the integrated mating feature 113 depicted in FIGS. 46-48 involving the at least one angled rubber wedge 124. In this example, the compression lock 126 may be configured in another portion of the integrated mating feature 113 that slides over and surrounds the post 13 such that the compression lock 126 opposes and interfaces with a surface of the post 13. Specifically, the compression lock 126 may include a rotating knob 128 operatively connected to a rubber stop 130 that interfaces the surface of the post 13 and may be moved into and out of compression with the surface of the post 13. In the unlocked position (FIGS. 49 and 51), the rotating knob 128 is in a first position in which the rubber stop 130 is not moved into compression with the surface of the post 13, such that the integrated mating feature 113 is able to move relative to the post 13. In the locked position (FIGS. 50 and 52), the rotating knob 128 is in a second position in which the rubber stop 130 is moved into compression with the surface of the post 13, such that the integrated mating feature 113 is not able to move relative to the post 13. It will be understood that the post 13 may include one or more recesses or indentations for receiving the rubber stop 130 when the rotating knob 128 is in the second position. In this manner, in addition to the downward force of gravity and of the user, the compression lock 126 is configured to help secure the integrated mating feature 113 in place relative to the post 13. The integrated mating feature 113 and the compression lock 126 may have a housing 132 configured to surround the components of the integrated mating feature 113 and compression lock 126 for aesthetic purposes, as depicted in FIG. 53.

FIGS. 54-57 depict the compression lock 126 in another embodiment. In this embodiment, the post 13 may include a plurality of indentations 134 on at least one side of the post 13 into which one or more projections 136 of the integrated mating feature 113 are configured to variably engage by action of the compression lock 126. That is, the compression lock 126 includes the rotating knob 128 which, when in the unlocked position (FIGS. 54 and 56), moves the one or more projections 136 out of engagement with one or more of the plurality of indentations 134, and in the locked position (FIGS. 55 and 57), moves the one or more projections 136 into engagement with the one or more of the plurality of indentations 134. The one or more projections 136 may be made of rubber or another material.

Figure 58:
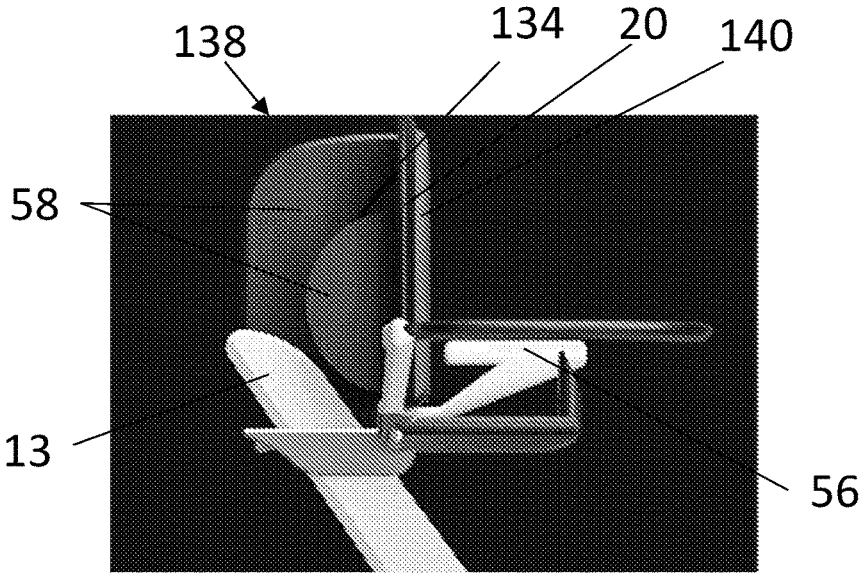
FIG. 58 is a side view of the seat assembly of the sit-to-stand convertible highchair.

As pictured in FIG. 58, the backrest 20 and/or the post 13 (including the base 13 and/or the post 15) may include a tray storage compartment 138 for storing the at least one removable tray 58 when not in use (when not supported between the plurality of armrests 56). The tray storage compartment 138, for example, may include a plurality of attachment mechanisms on the back of the backrest 20 to which the at least one removable tray 58 are configured to attach. The highchair 10 may also include other storage compartments for, for example, baby wipes, bibs, small toys, tablets, etc. It is understood that the backrest 20 and the post 13 are provided as non-limiting examples for where the various storage compartments described herein may be located, and that the tray storage compartment 138 and other storage compartments may be located at any other suitable location on the highchair 10.

The frame 12 including the base 15 and the post 13, the foot platform 16 and the seat assembly 14 including the backrest 20, support surface 18, plurality of armrests 56, at least one removable tray 58 and crotch post 38, may be made from a rigid material, such as non-toxic resin infused paper, wood, bamboo, metal, polymer, and may be dishwasher safe. The non-toxic resin-infused paper, for example, may be made of approximately 65% FSC®-certified or recycled paper content, and 35% phenolic resin. Any two or more of the base 15, the post 13, the support surface 18, the backrest 20, the backrest insert 36, the foot platform 16, and any other component of the highchair may be made of the same material, or may alternatively be made of different materials. Additionally, each component of the highchair 10 described herein may be color customizable.

The seat assembly 14, for example one or more of the support surface 18, the backrest 20 and the backrest insert 36, may include a removable soft cover 140 configured to removably attach to the seat assembly 14. The removable cover 140 may be customizable (in color, texture, material, etc . . . ), interchangeable and washable. The cover 140 may be made of, for example, an antibacterial fabric or have an antibacterial finish and may be machine washable and easy to clean. The cover 140 may be made with an organic, sustainable, durable material. The cover 140 may be removably attached to the seat assembly 14 with magnets. It is understood, however, that magnets are provided as a non-limiting example and that the cover 140 may be removably attached to the seat assembly with another suitable attachment means, such as for example a hook and loop fastener, buttons, snaps, clips, ties, etc.

Figure 59:
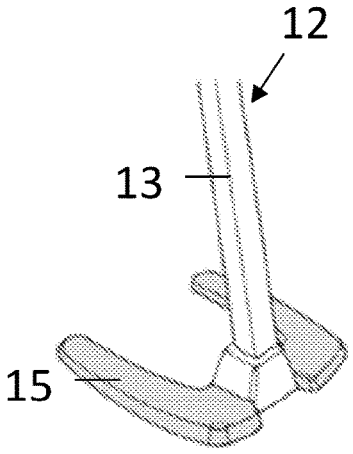
FIG. 59 is a perspective view of the frame of the sit-to-stand convertible highchair.
Figure 60:
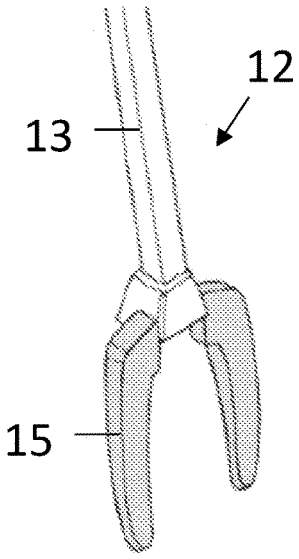
FIG. 60 is another perspective view of the frame of the sit-to-stand convertible highchair.
Figure 61:
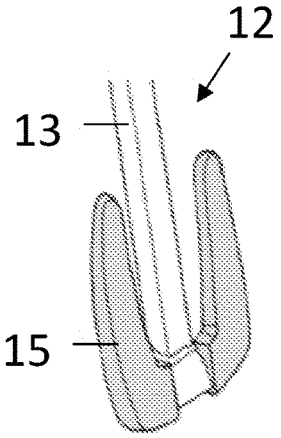
FIG. 61 is another perspective view of the frame of the sit-to-stand convertible highchair.

The frame 12 may be foldable at a hinge at any point along the frame 12, such that the frame 12 may fold for compact storage or transport. Additionally or alternatively, as depicted in FIGS. 59-61, the base 15 of the frame 12 may be configured to fold relative to the post 13 for compact storage or transport. Specifically, as depicted, the base 15 may be hingedly attached to the post 13 at the hinge and may be configured to rotate relative to the post 13 to move between an unfolded configuration (FIG. 59) and a folded configuration (FIG. 61). The frame 12 may include a fold lock to lock the frame 12 in the unfolded and folded configurations. The frame 12 may also include a handle for ease of transporting the highchair 10 in the folded position.

The base 15 of the frame 12 may include wheels or feet on or adjacent the bottom thereof. For example, the wheels may be located on a bottom surface of the base 15, such that they are disposed between the floor and the base 15. In another embodiment, the wheels may be located on a top surface or a side surface of the base 15, such that the base 15 directly contacts the floor and the highchair 10 is moved with the wheels by tilting the highchair 10 at least partially toward its side so that the wheels contact the floor. In any embodiment in which the frame 12 includes wheels, the wheels may include a wheel lock to variably lock the wheels. Additionally or alternatively, the bottom of the base 15 may include an anti-slip material to keep the frame 12 in place on the floor.

Figure 62I:
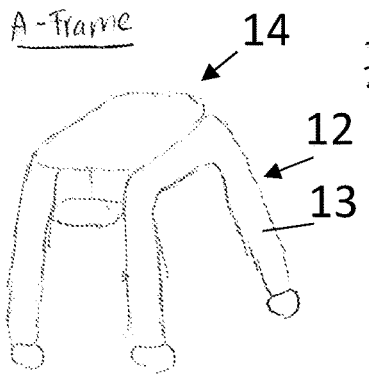
Figure 62J:
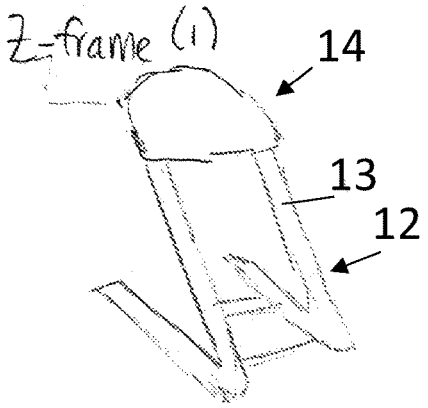
Figure 62K:
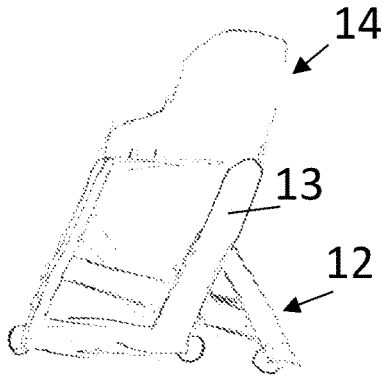

The frame 12 may include a variety of shapes and sizes. For example, as depicted in FIG. 1 and additionally in FIGS. 62A-B, the base 15 of the frame 12 may include two extending support arms (for example, forming a U-shape, a W-shape or M-shape), extending toward the front or back of the highchair 10, and a single vertically extending post 13 for adjustably supporting the seat assembly 14 and the foot platform 16. A variety of other non-limiting example frame 12 configurations and shapes are depicted in FIGS. 62C-K. For example, instead of a U-shape, W-shape or M-shape, the base 15 of the frame 12 may have an X-shape (FIG. 62C), an O-shape (FIG. 62D), or any other suitable shape that can support and distribute the weight of the highchair 10 and user. The frame 12 may also include more than a single vertically extending post 13, as depicted in FIGS. 62E-K. In some examples, the frame 12 does not have a base 15, whatsoever, and instead simply includes a plurality of vertically extending posts 13, as depicted in FIGS. 62F, 62G, and 62I. For example, the frame 12 may include four vertically extending posts 13 extending either straight or angled outward relative to the seat assembly 14 to support the seat assembly 14. The vertically extending posts 13 may or may not include supporting cross arms between at least two of the vertically extending posts 15. The frame 12 may otherwise have an A-frame (FIG. 62I), Z-frame (FIG. 62J), or Y-frame (FIG. 62K) shape. It is understood that the above described shapes and configurations of the frame 12 are provided as non-limiting examples, and other shapes and configurations of the frame 12 may be applicable to the highchair 10. A food net may also be attached to the vertically extending posts 13 of the frame 12 for catching food dropped from the seat assembly 14.

Figure 63:
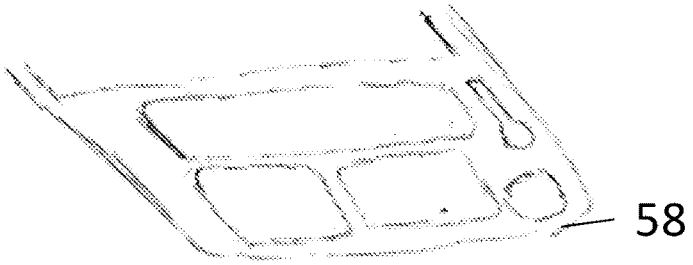
FIG. 63 is a perspective view of the at least one removable tray of the sit-to-stand convertible highchair.
Figure 64:
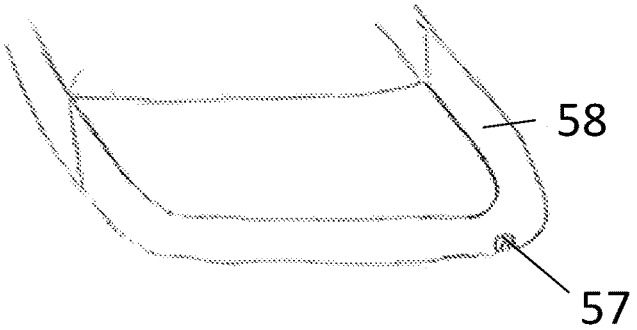
FIG. 64 is another perspective view of the at least one removable tray of the sit-to-stand convertible highchair.
Figure 65:
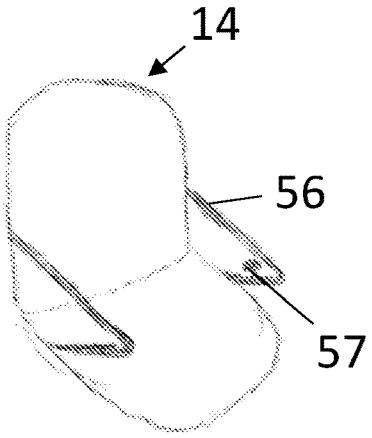
FIG. 65 is a perspective view of the seat assembly of the sit-to-stand convertible highchair.
Figure 66:
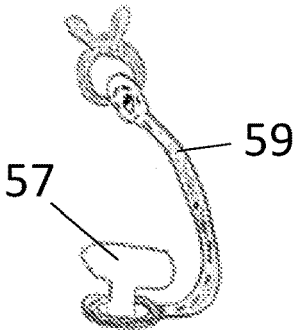
FIG. 66 is a perspective view of a notch on the seat assembly of the sit-to-stand convertible highchair.
Figure 67:
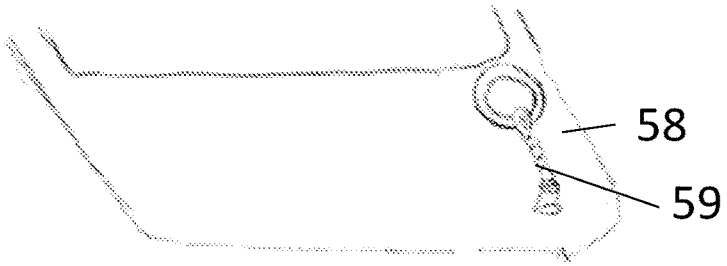
FIG. 67 is a perspective view of the at least one removable tray of the sit-to-stand convertible highchair.

The highchair 10 may be configured with various additional accessories. For example, with reference to FIG. 63, the at least one removable tray 58 may be configured to have a compatible mat placed on the tray to hold food, drinks, utensils, toys, etc. The mat may be affixed to the at least one removable tray 58 with, for example, suction. Otherwise, the mat may simply lie on the at least one removable tray 58. The mat may be, for example, a silicone mat. In an alternative embodiment, the at least one removable tray 58, itself, may be configured with formed recesses to hold food, drinks, utensils, etc. For example, the at least one removable tray 58 may have a ridge around a periphery thereof. The at least one removable tray 58 may be configured to have a tether attached thereto. For example, as depicted in FIG. 64, the at least one removable tray 58 may include a loop or notch 57 onto which the tether 59 may attach. The mat may additionally or alternatively include a loop or notch in the same manner. The tether 59 may be used, for example, to hold toys, utensils, or other items on the highchair 10 so that they do not fall to the ground. As depicted in FIGS. 65 and 66, one or more of the plurality of armrests 56 may include such a loop or notch 57 for the tether 59. The tether 59 may also attach to the highchair 10 (e.g., the at least one removable tray 58 and/or the plurality of armrests 56) with, for example, suction, as shown in FIG. 67.

The highchair 10 may include one or more sensors incorporated therein for alerting a caretaker if the user is not in a proper standing or sitting position in the highchair 10, or if the frame 12 is not properly stabilized on the floor. It will be understood that the sensors may be configured to perform other suitable functions on the highchair 10. For example, the sensors may pair with a mobile application on the caretaker's mobile phone. The mobile application and associated website may provide discounts, incentives, safety alerts, subscription access, and access to a community of like-minded users. Additionally, the mobile application may be used to adjust the positions of the seat assembly 14 and the foot platform 16. In an embodiment, the highchair 10 may include speakers built into any portion of the highchair 10 and the mobile application may be configured to wirelessly connect (e.g., via Bluetooth) to the speakers to play music.

Although the above disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. A sit-to-stand convertible highchair, comprising:

a frame configured to support the sit-to-stand convertible highchair above a floor;

a foot platform adjustably mounted on the frame;

a seat assembly adjustably mounted on the frame above the foot platform, the seat assembly including:

a backrest, and a support surface configured to convert between a sitting configuration, in which a user sits on the support surface, and a standing configuration, in which the user extends through the support surface to stand on the foot platform.

2. The sit-to-stand convertible highchair according to claim 1, wherein the support surface includes a peripheral seat frame and a central seat portion within the peripheral seat frame, wherein the central seat portion of the support surface is configured to be movable relative to the peripheral seat frame to convert between the sitting configuration, in which the central seat portion of the support surface is in a first position flush with the peripheral seat frame to provide a continuous sitting surface on which the user may sit, and the standing configuration, in which the central seat portion of the support surface is in a second position exposing an aperture defined by the peripheral seat frame through which the user may extend to stand on the foot platform.

3. The sit-to-stand convertible highchair according to claim 1, further comprising a plurality of armrests each arranged on a respective lateral side of the seat assembly, and at least one removable tray configured to extend between and variably engage with the plurality of armrests.

4. The sit-to-stand convertible highchair according to claim 3, wherein at least one of the plurality of armrests is movable to variably engage and accommodate the at least one removable tray.

5. The sit-to-stand convertible highchair according to claim 3, wherein at least one of the plurality of armrests is vertically pivotable or laterally pivotable.

6. The sit-to-stand convertible highchair according to claim 3, wherein the plurality of armrests, support surface and backrest are each supported on a support rod.

7. The sit-to-stand convertible highchair according to claim 6, wherein the support rod includes a recessed track in which at least one of the plurality of armrests is configured to slide.

8. The sit-to-stand convertible highchair according to claim 3, wherein the removable tray includes a spring-loaded lock configured to variably engage with at least one of the plurality of armrests, and a release lever configured to release the spring-loaded lock to variably disengage with the at least one of the plurality of armrests.

9. The sit-to-stand convertible highchair according to claim 2, wherein the central seat portion of the support surface is pivotably attached to the peripheral seat frame and is configured to be pivotable relative to the peripheral seat frame to convert the sit-to-stand convertible highchair between the sitting configuration and the standing configuration.

10. The sit-to-stand convertible highchair according to claim 9, wherein the central seat portion of the support surface includes a cushion on an underside of the central seat portion, and in the standing configuration, the central seat portion of the support surface is pivoted upward relative to the peripheral seat frame such that the cushion forms a supplementary backrest for the user as the user extends through the aperture to stand on the foot platform.

11. The sit-to-stand convertible highchair according to claim 2, further comprising a crotch strap secured to the peripheral seat frame at a first end of the crotch strap and at a second end of the crotch strap, the crotch strap extending across the aperture from the first end to the second end.

12. The sit-to-stand convertible highchair according to claim 11, wherein the crotch strap is removably secured to the peripheral seat frame at at least one of the first end or the second end.

13. The sit-to-stand convertible highchair according to claim 2, further comprising a cushion on an underside of the central seat portion.

14. The sit-to-stand convertible highchair according to claim 3, wherein the at least one removable tray is foldable.

15. The sit-to-stand convertible highchair according to claim 1, wherein the frame includes a base and a post, and wherein at least one of the seat assembly and the foot platform includes an integrated mating feature configured to variably secure the at least one of the seat assembly and the foot platform to the post.

16. The sit-to-stand convertible highchair according to claim 15, wherein the post includes a plurality of notches along a vertical direction thereof, and the integrated mating feature of at least one of the seat assembly and the foot platform includes an adjustment latch configured to releasably engage at least one of the notches.

17. The sit-to-stand convertible highchair according to claim 15, wherein the post includes a plurality of geometric recesses along a vertical direction thereof, and the integrated mating feature of at least one of the seat assembly and the foot platform includes a corresponding geometric projection configured to variably engage at least one of the plurality of geometric recesses.

18. The sit-to-stand convertible highchair according to claim 15, wherein the integrated mating feature of at least one of the seat assembly and the foot platform includes at least one angled rubber wedge configured to variably engage the post.

19. The sit-to-stand convertible highchair according to claim 15, wherein the integrated mating feature of at least one of the seat assembly and the foot platform further includes a compression lock configured to move between an unlocked position, in which the integrated mating feature is able to move relative to the post, and a locked position, in which the integrated mating feature is unable to move relative to the post.

20. The sit-to-stand convertible highchair according to claim 1, wherein the seat assembly further includes a harness assembly including at least one crotch harness strap, at least two waist harness straps, and at least two shoulder harness straps, and wherein each of the at least one crotch harness strap, the at least two waist harness straps, and the at least two shoulder harness straps are independently connectable to each other.

21. A sit-to-stand convertible highchair, comprising:

a frame configured to support the sit-to-stand convertible highchair above a floor;

a foot platform adjustably mounted on the frame;

a seat assembly adjustably mounted on the frame above the foot platform, the seat assembly including:

a backrest, a support surface movable for converting the sit-to-stand convertible highchair between a sitting configuration, in which the support surface is configured to support a user in a sitting position, and a standing configuration, in which the foot platform is configured to support the user in a standing position; and a crotch support configured to aid in supporting the user in the standing position in the standing configuration;

wherein in the sitting configuration, the foot platform is configured to support the user's feet.

* * * * *